US007796913B2

(12) United States Patent
Berg et al.

(10) Patent No.: US 7,796,913 B2
(45) Date of Patent: Sep. 14, 2010

(54) TONER REMOVAL APPARATUS WITH PROFILED BLADE

(75) Inventors: Richard H. Berg, Parma, NY (US); Gregory L. Kowalski, Victor, NY (US); Francisco L. Ziegelmuller, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 61 days.

(21) Appl. No.: 12/261,260

(22) Filed: Oct. 30, 2008

(65) Prior Publication Data

US 2010/0111558 A1 May 6, 2010

(51) Int. Cl.
*G03G 15/16* (2006.01)

(52) U.S. Cl. ..... 399/101; 399/350; 399/351

(58) Field of Classification Search ..... 399/101, 399/123, 350–353
See application file for complete search history.

(56) References Cited

U.S. PATENT DOCUMENTS 4,866,483 A 9/1989 Davis et al.
5,426,485 A 6/1995 Fujita et al.
6,453,134 B1 9/2002 Ziegelmuller et al.
6,901,227 B2 5/2005 Ziegelmuller et al.
7,031,634 B2 4/2006 Ziegelmuller et al.
2004/0156650 A1 8/2004 Ziegelmuller et al.
2007/0231004 A1 10/2007 Ziegelmuller et al.
2008/0232874 A1 9/2008 Parks et al.

FOREIGN PATENT DOCUMENTS

JP 05-341696 * 12/1993
JP 06-027860 * 2/1994
JP 2005 181569 A 7/2005

* cited by examiner

*Primary Examiner*—Hoang Ngo
(74) *Attorney, Agent, or Firm*—Donna P. Suchy

(57) ABSTRACT

A cleaning station for removing particulate material from a moving web in an electrographic printer/copier includes a customer-replaceable web-cleaner device with a support bracket/backup shoe assembly. The web-cleaner has two wiper blades, including one or more profiled metal blades, each having a distinguishment such that the distinguishment distinguishes one wiper blade from the other wiper blade when the blades are locked into the cleaner sump by springs, to facilitate material removed from the web. The wiper cleaning blades and the cover assembly are easily replaceable by the operator in the correct order.

24 Claims, 17 Drawing Sheets

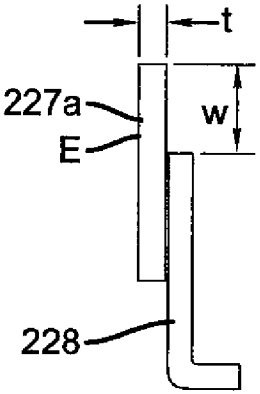
FIG. 12A
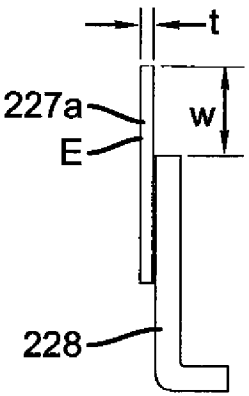
FIG. 12B
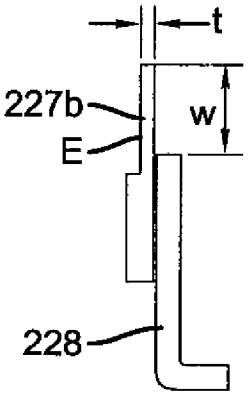
FIG. 12C
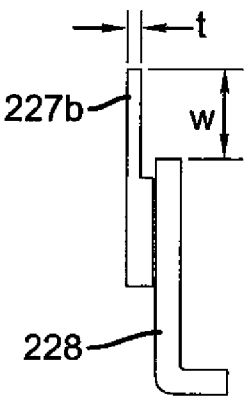
FIG. 12D
FIG. 12E
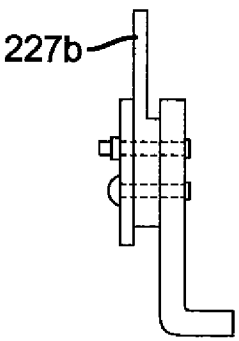
FIG. 12F
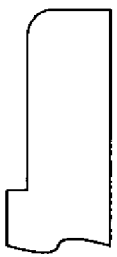
FIG. 12G
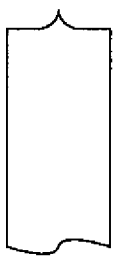
FIG. 12H
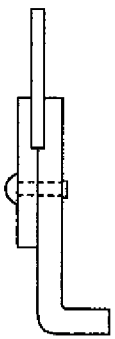
FIG. 12I

TONER REMOVAL APPARATUS WITH PROFILED BLADE

CROSS REFERENCE TO RELATED APPLICATIONS

This application relates to commonly assigned, U.S. application Ser. No. 12/261,274 filed Oct. 30, 2008, entitled: "TONER REMOVAL APPARATUS FOR ELECTROGRAPHIC PRINTER".

FIELD OF THE INVENTION

This invention relates in general to improvements in a cleaning apparatus of the type used, for example, in electrographic document printers or copiers to remove residual toner, carrier, dust, lint, paper fibers, and the like, from a moving surface, typically in the form of an endless web. More particularly, it relates to a removable web cleaning apparatus having one or more profiled metal blades that can be precisely and repeatedly positioned adjacent to a moving web that is to be continuously cleaned by the apparatus.

BACKGROUND OF THE INVENTION

Many electrographic printers/copiers use endless webs for recording and/or transferring images, as well as for conveying image-receiving sheets (typically sheets of paper) between image-transfer and other image-processing stations within the instrument. To assure high quality results, it is necessary to maintain the surfaces of such webs free of particulate contaminates (toner, dust, lint, paper fibers, etc) that may ultimately transfer to the image-receiver sheet or otherwise degrade the quality of images produced thereon. Heretofore, a variety of web-cleaning devices have been devised and used to satisfy this need. One such device is generally referred to as a "blade cleaner" and, as its name suggests, it comprises one or more elongated flexible blades having an edge positioned to contact a moving web to either scrape or wipe particles from the web, depending on the angle of contact between the blade and the web surface. Different types of blade cleaners, both scrapers and wipers, are disclosed, for example, in U.S. Pat. No. 5,426,485 in which cleaning blades serve to remove particulate material from an endless elastic belt used to convey copy sheets in an electrostatic copier.

In U.S. Pat. No. 4,866,483, a blade-type cleaning station is disclosed for use in a tabletop electrostatic printer. Here a pair of spaced, parallel cleaning blades set to operate in a wiping mode, serves to remove or scavenge residual toner from an endless photoconductive image-recording belt following transfer of a toner image to a copy sheet. As the image-recording belt moves along its endless path, scavenged toner falls into a sump from which it is continuously removed by a rotatably driven auger. The rotating auger, which is located in the bottom of the sump, serves to transport the scavenged toner to a remote receptacle that can be readily removed from the machine and emptied by the operator. In this disclosure, the cleaning station is rigidly mounted on the printer's base frame. To gain access to the cleaning station for servicing, and the like, the entire print engine, including the image-recording belt, is mounted on a pivoting frame for movement towards and away from the cleaning station. As it moves towards the cleaning station, the print engine's image-recording belt pressingly engages the respective edges of the cleaning blades and is cleaned by the blades as the belt advances along its endless path. Upon being moved away from the cleaning station, sufficient space is eventually provided to enable the machine operator or service personnel to service the cleaning station, e.g., to vacuum scavenged toner from that portion of the sump directly beneath the cleaning blades, or to replace the cleaning blades themselves.

While the cleaning station disclosed in the above-noted patent affords certain advantages not found in prior devices, it may still be viewed as problematic in certain respects. For example, the rotating auger system used to transport scavenged particles from the blade cleaner to a remote receptacle for removal is a relatively complex and costly component of the machine, one that is subject to eventually fail. Further, since the cleaning station is fixed within the machine frame, pivoting the relatively heavy print engine through a large arc away from the cleaning station can only be accomplished by service access. This, of course, necessitates a relatively formidable and complex mounting mechanism, one that is capable of handling and counter-balancing the relatively heavy weight of the print engine. Ideally, the print engine should remain stationary, and the cleaning station, like most other image-processing stations, should be movable relative to it.

Further, once the print engine has been pivoted to its service position to gain access to the scavenged particle sump for vacuuming, blade replacement, etc., the entire sump is exposed to ambient air, and any air currents in the vicinity of the open sump, as occurs during movement of the print engine, can have the effect of blowing toner, dust, etc. throughout the instrument. Ideally, the scavenged particle sump should be easily removed from the vicinity of the machine frame while scavenged particles are confined therein. Once removed, the sump can then be discarded and replaced with a new sump, or it may be cleaned at a location safely spaced from the machine and then replaced.

In the embodiment disclosed, an endless web to be cleaned is part of a conveyor system used to transport image-receiver sheets past one or more image-transfer stations in an electrophotographic printer. The web-cleaning apparatus comprises a single metallic blade or a pair of cleaning blades, one or both of which are made of a metallic material, positioned to operate in a wiping mode to scavenge particles from the web surface, and a sump housing that serves both to support the cleaning blades and to collect and retain particles wiped from the web by the blades. Preferably, the blades are designed to cooperate with a hard backup "shoe" located on the opposite side of the web surface from that contacted by the blades to produce a uniform wiping pressure across the web width while minimizing any tendency for the web to stretch. It is also preferred that the cleaning apparatus be fabricated so as to be easily removable for cleaning after the sump housing has become filled with particles and have blades that can remove hard to remove toner particles, such as those from chemically prepared toner or that can remove toner from webs that have overcoats to absorb oil from 2-sided prints and to prevent oil contamination to other critical parts of the print engine. Another function of at least one of these blades is to remove paper contamination that sticks to the web and are much harder to remove the toner particles. The blades need to be readily replaced, as needed, with new blades. This replaceability of the blades necessitates a reliable mechanism by which each new blade can be precisely positioned in contact with the web surface exerting a predetermined and uniform pressure on the web across its entire width.

SUMMARY OF THE INVENTION

A new blade cleaner apparatus for cleaning particulate material from a moving web in an electrographic printer/ copier, including a sump having a sump body with molded components, defining a cavity with integral molded baffles, releasable wiper blades made so that the blades do not fall out when inverted; one, two or more releasable wiper blade(s), each having a distinguishment such that the distinguishment distinguishes one wiper blade from the other wiper blade (one such a distinguishment may be the blade material such as a metallic blade and a polyurethane blade and the metallic blade may be profiled); and a removable cover assembly to facilitate the removal of debris material from the sump without removing the wiper blades. The molded components include stops, placement devices and other components that can engagedly cooperate with springs and other biasing devices. The web-cleaning device is attached to a lower bracket and a backup shoe assembly for selectively positioning the web-cleaning device in a web-cleaning position so that the web-cleaning apparatus pressingly engages said surface.

BRIEF DESCRIPTION OF THE DRAWINGS

The invention and its objects and advantages will become apparent upon reading the following detailed description and upon reference to the drawings, in which:

FIGS. 8-12 show several embodiments of the cleaning blades having either a polyurethane or a metallic material and the metallic material having variations in profile to arrive at various levels of stiffness/unit length.

DETAILED DESCRIPTION OF THE INVENTION

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention, as defined by the appended claims.

Figure 1:
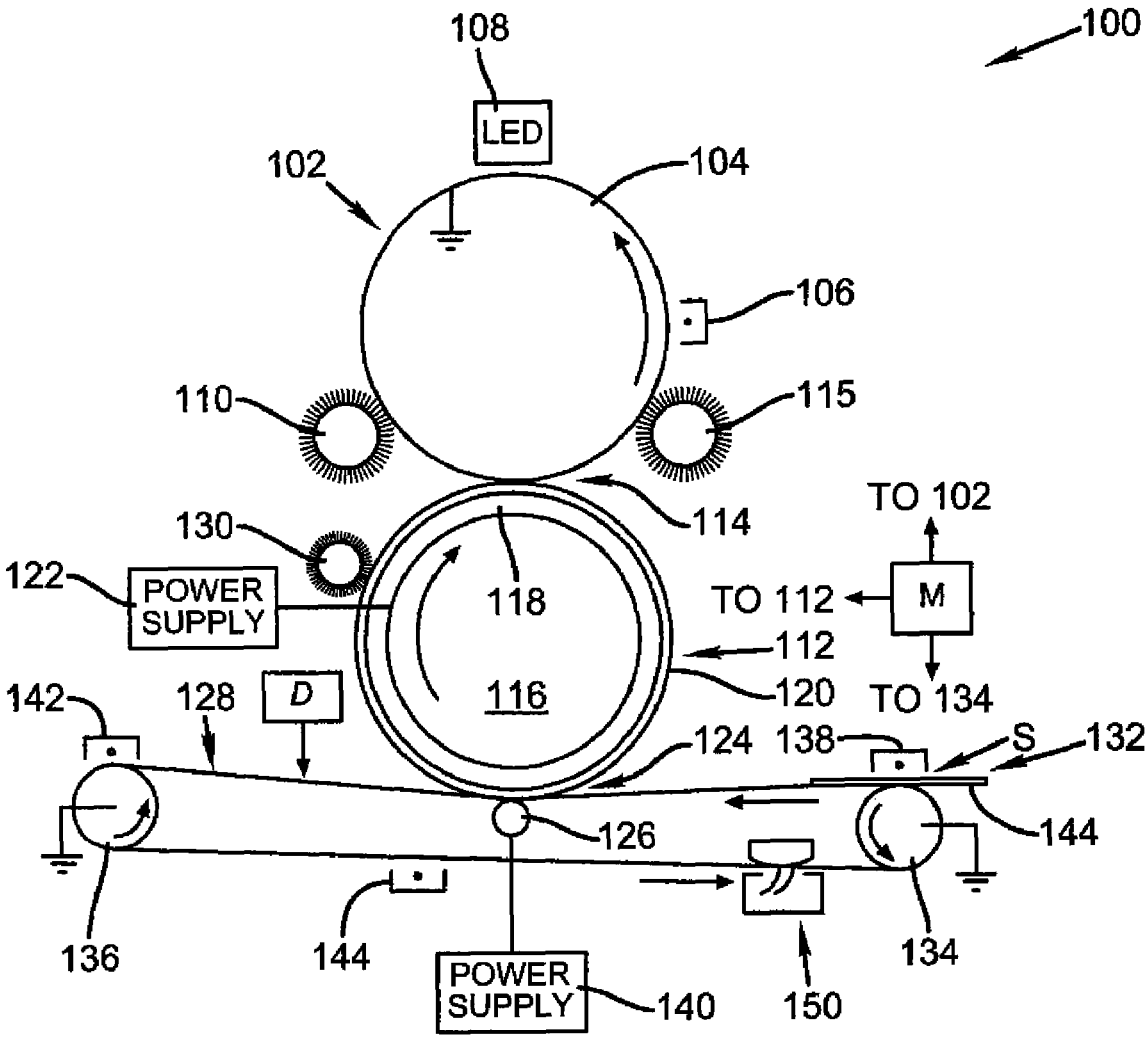
FIG. 1 is a schematic illustration of an electrographic document printer.

Referring now to FIG. 1, a conventional electrophotographic document printer 100 in which the invention has utility is shown to comprise a primary image-forming member 102, for example, a rotatably driven conductive drum having an outer surface of a photoconductive material. One or more transferable toner images are formed on the photoconductive surface of drum 104 by first uniformly charging the surface with electrostatic charge provided by a corona charger 106 or the like. The uniformly charged surface is then imagewise exposed to radiation provided, for example, by a LED writer 108, thereby selectively discharging the charged surface and leaving behind a latent charge image. Finally, the latent charge image is rendered visible (developed) by applying electroscopic toner particles using a magnetic brush applicator 110, or the like. In some printers of this type, a series of toned process control patches (images) are also formed on the surface of the image-recording element, such patches being located in the interframe region between successive image frames.

The above-noted toner images and toned process control patches are then transferred to an intermediate image-transfer member 112 at a transfer nip 114. A cleaning brush 115 prior to recycling the image-recording member through the image-forming process removes any residual toner on the image-recording member 104. The image-transfer member may comprise, for example, an electrically conductive drum 116 having a compliant blanket 118 with a relatively hard overcoat 120. The conductive drum is electrically biased by a power supply 122. The toner images transferred onto intermediate image-transfer member are then re-transferred to an image-receiver sheet S at a transfer nip 124 formed by a relatively small transfer roller 126 and an endless sheet-transport web 128 made of a dielectric material such as a polymer compound. A cleaning brush 130 removes residual toner on member 112.

The image-receiver sheets S are presented to the endless sheet-transport web 128, also referred to as a surface in an electrographic printer and that might have an overcoat to absorb oil from 2-sided prints, at a feed station 132. Web 128 is trained around a pair of rollers 134 and 136, and a motor M serves to drive roller 134 in the direction indicated by the arrow. Motor M also serves to rotatably drive the image recording and image-transfer drums. The image-receiver sheets (e.g., paper or plastic) attach to web 128 at a corona charging station 138, which operates to charge the top surface of the sheet so that it becomes electrostatically attracted to the web. The grounded rollers 134 and 136 serve to charge to the rear side of the web. Toner images are electrostatically attracted, and thereby transferred, to the image-receiver sheets by a suitable electrical bias applied to transfer roller 126 by power supply 140. There are various chargers including a corona charger 138 at the sheet-feed station 132, a detack charger 142 that serves to detack the image-receiver sheets as they wrap around transport roll 136, thereby freeing the sheets for further transport to a toner fusing station, (not shown) as well as a web conditioning charger 144, that serves to discharge the web and neutralize toner images on the web surface for easier cleaning operation. Note, being outside the image frame areas on the image-recording drum, any toned process-control patches transferred to the image-transfer member 112 will re-transfer directly to the transport web in the region between successive image-receiver sheets. These toned patches must be removed from the web before receiving a new image-transfer sheet. Otherwise, the toner from these patches will transfer to the rear side of the image-receiver sheets.

Now in accordance with the present invention, a web-cleaning apparatus 150 is provided for removing not only the random toner particles, dust, paper debris, etc., that may accumulate on the outer surface sheet of the transport web 128 during repeated use of the printing machine described above, but also any relatively heavy deposits of toner that may be transferred to the web as the result of forming the aforementioned process-control patches on the image-recording drum, paper jams, misregistration of the toner image with the image-receiver sheets, etc.

Figure 2:
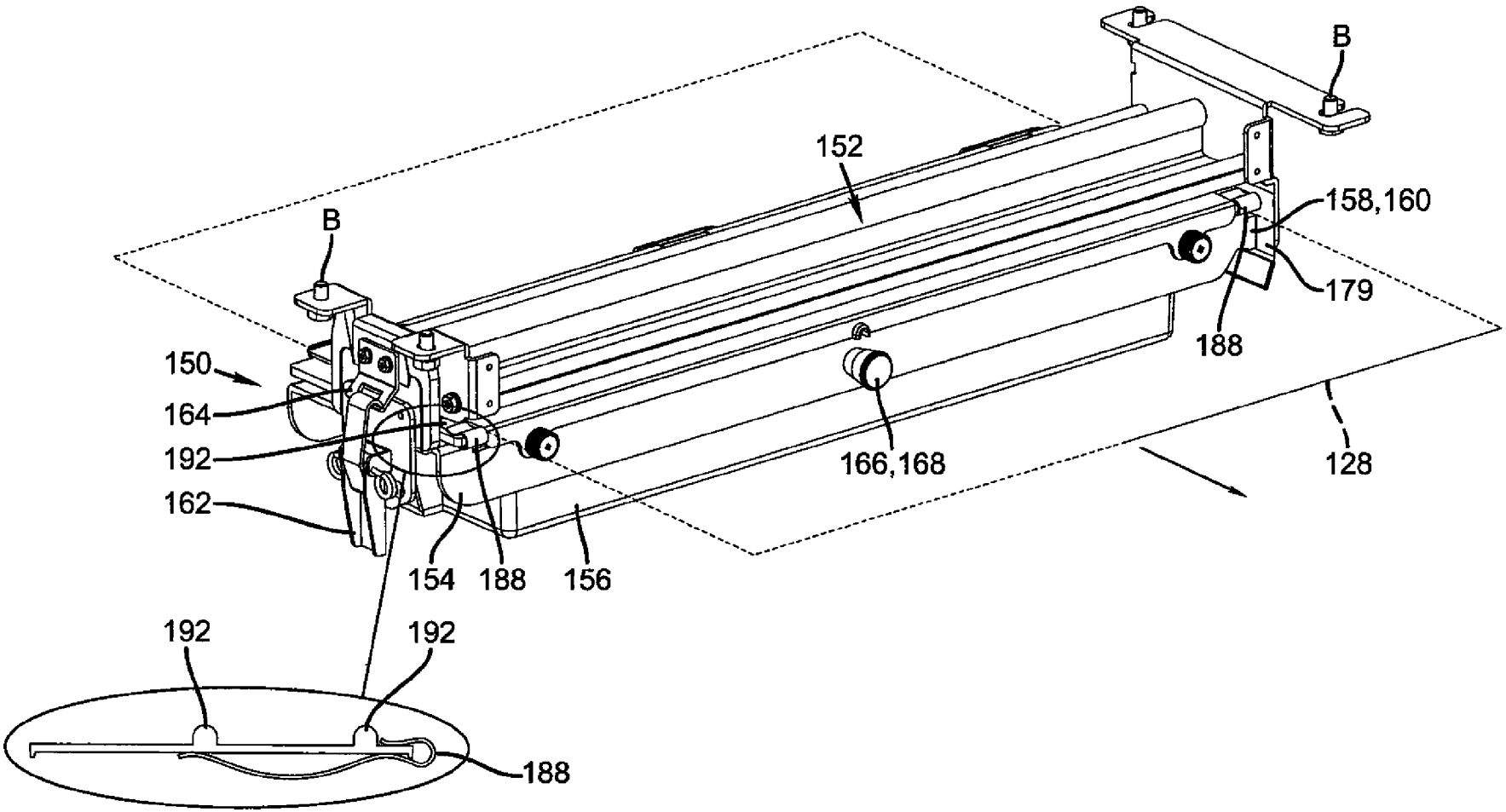
FIG. 2 is a perspective view of a preferred embodiment of the web cleaning apparatus of the invention, such apparatus shown to be operating on the surface of a sheet-transport web of the FIG. 1 printer.
Figure 3A:
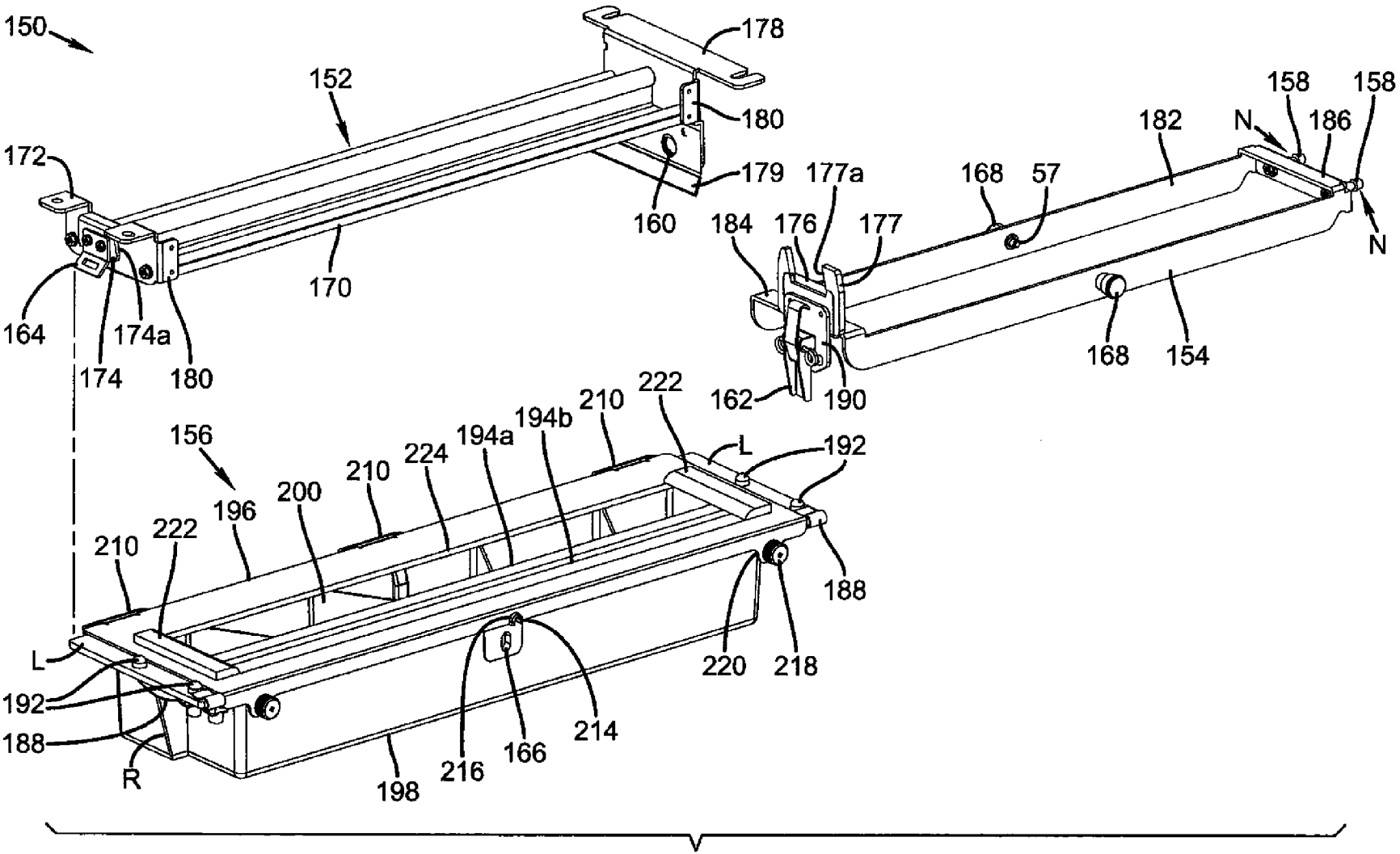
FIG. 3A is an exploded, perspective view of three major components of the web-cleaning apparatus.
Figure 3B:
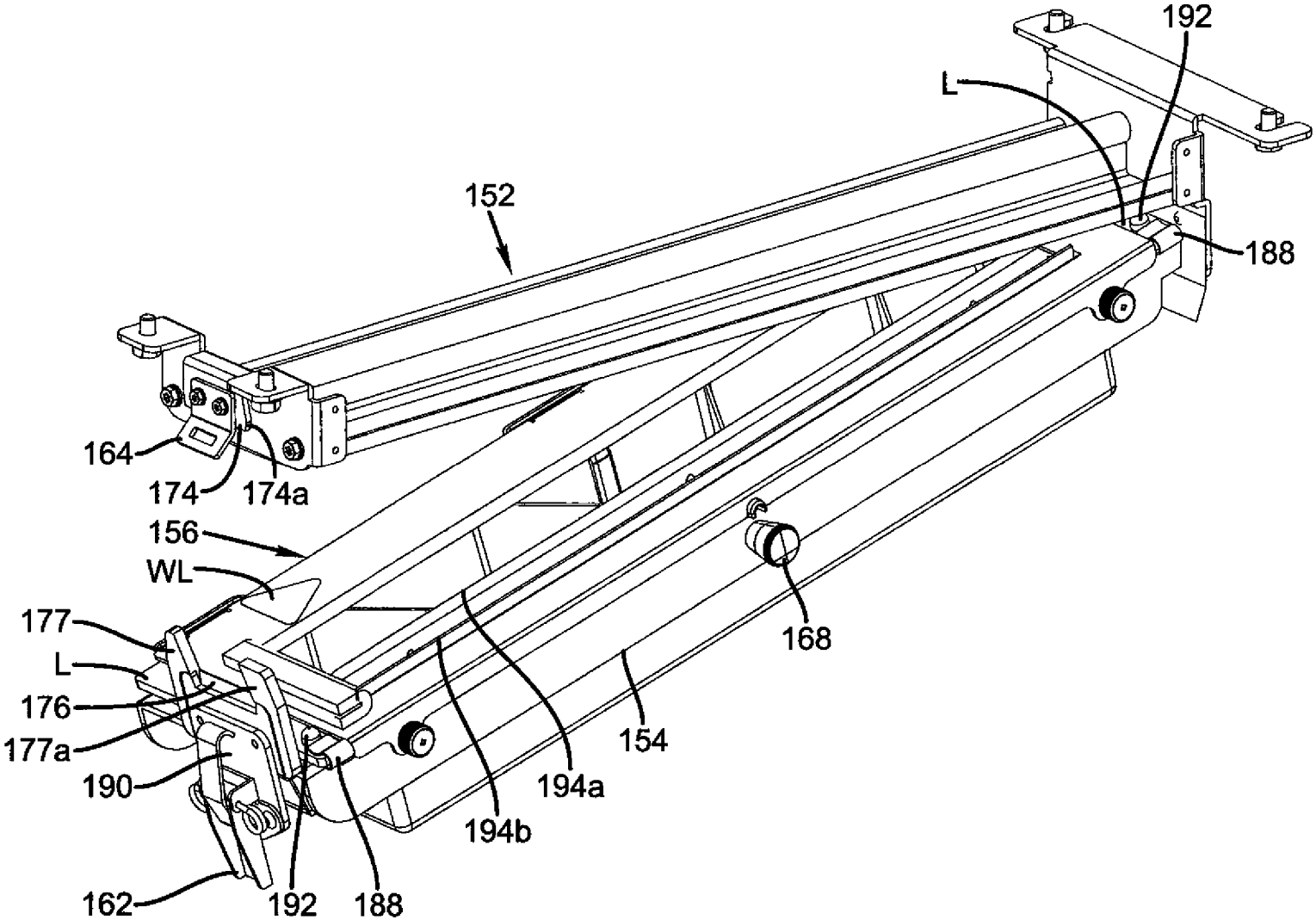
FIG. 3B is a perspective view illustrating the pivotal relationship between the lower bracket and backup shoe assemblies of the apparatus.

Referring to FIGS. 2 and 3, a preferred web-cleaning apparatus 150 is shown as comprising three major components, namely a backup shoe assembly 152, a lower bracket assembly 154 and a web-cleaning device, hereafter referred to as a cartridge 156, in an operating position with respect to a moving sheet-transport web 128. It is clear that this web-cleaning device may be removable as a whole, and replaceable or it may be a device that is difficult to remove and meant to be a permanent installation. The term cartridge is in no way meant to limit the device functionality. The backup shoe assembly 152 is permanently attached to the printer through screws B at front and at rear. The lower bracket assembly 154 is coupled to the backup shoe assembly at the rear by mating notched and conically shaped pins 158 in the bracket to a hole/slot pattern 160 in the backup shoe assembly and at front through a latch 162 and a latch keeper 164. The web-cleaning cartridge 156 is attached to the lower bracket assembly via one or more slot features 166 on the sides of the cartridge that are coupled or mated to plungers 168 in the lower bracket assembly and this allows the operator to remove the lower bracket assembly with the web-cleaning cartridge as one unit (FIG. 3B). The web moves in the direction shown by the arrow and further described in the cross-referenced U.S. Pat. No. 6,453,134, issued on Sep. 17, 2002, in the names of Ziegelmuller et al., the contents of which being hereby incorporated by reference herein.

Referring to FIG. 3A, the backup shoe assembly 152 has a shoe 170, preferably made of Aluminum or steel, with a large radius of curvature, such as 500 mm, a T shaped form to increase its rigidity and thus reduce bowing or deformation generated by the loading of the cleaning blades or stops, and which has a conductive, wear-resistant coating, such as one including chromium, which engages the web 128 to generate a wrap; a front bracket 172 that spaces the shoe 170 from the machine frame to provide proper wrap with the web and that has a tab feature 174 with a slanted feature 174*a* on its side for mating with a similar tab feature 176 that also has a guide adaptor 177 with a mating slanted feature 177*a* in the lower bracket assembly 154 at front and serves as a mount for the latch keeper 164, and a rear bracket 178 that also serves to set the proper wrap of the shoe with the web 128 and holds a hole and a slot feature 160 for mating with notched and conically shaped pins 158 that guide the mating of the pins 158 at the rear of the lower bracket assembly 154 into the correct position with respect to the shoe. The notches N in the pins serve to hold the lower bracket assembly with the web-cleaning cartridge in place at the rear whenever the operator needs to drop the web-cleaning cartridge from contact with the web 128, as shown in FIG. 3B. These notches reduce the likelihood of the lower bracket assembly collapsing at the rear whenever the operator lowers the bracket at front. The pins 158 can be fixed to the lower bracket assembly through bolts or weldment as shown in FIG. 3B. Both front and rear brackets 172, 178 have side tab features 180 to hold a static dissipative discharge brush facing the inside of the web surface to control triboelectric charge build up (not shown here). Additionally, to prevent the operator from inserting the pins into spacing between the rear bracket and machine frame (not shown), a shield and tape assembly 179 can be added to the rear bracket 178 with mating hole/slot features that are oversized from those in the rear bracket and the shield, which is made of a thin sheet of steel or other appropriate material, will extend down to block any spacing between the rear bracket 178 and machine frame, and a tape is wrapped on the bottom edge of the shim prevent any damage or cutting when performing servicing. The thin sheet will provide enough flexibility to prevent interference with the motion of dropping the web transport for web replacement operation. The shield and tape assembly 179 is attached to the rear bracket through 2 bolts.

The lower bracket assembly 154 has a rectangular opening 182 for housing the web-cleaning cartridge; sides with plungers 168 for mating with slot features 166 in the cleaning cartridge 156 and for locking the cartridge in place; front and rear flat surfaces 184, 186 for supporting the web-cleaning cartridge 156 through the end springs 188, one at front and the other at rear of the cartridge, and bearing the end spring load when the cartridge is in its operative condition; a front tab feature 176 that holds the latch bracket 190, the latch 162 and the guide adaptor 177 that has a slanted feature 177*a* for mating with the front bracket tab slanted feature 174*a*, and the notched and conically shaped pins 158 described above. The guide adaptor 177 and the latch bracket 190 are held together through 2 bolts. The latch 162 is attached to the latch bracket 190 through 2 bolts.

The web-cleaning cartridge 156 has two end springs 188, one at front and one at rear, that load the cartridge against the shoe until four strategically positioned stops 192 contact the shoe 170. Each end spring 188 is positioned preferably proximate a lip L on one of the sides of the sump. This side could be on the shorter sides, on the front or the back areas of the sump. In one preferred embodiment the end spring(s) are positioned between the sump and the flat surfaces 184, 186 of the lower bracket assembly 154 such that end spring 188 biases the sump towards the shoe 170 until one or more stop(s) 192, shown in this embodiment molded onto the sump, abut against the shoe 170 as shown in FIG. 2. The end spring(s) 188 and the stop(s) 192 allow the higher precision blade engagement necessary to optimize blade angle and reduce support on the wiper blade. The stops have been located outside the web so that they do not wear or load the web. The end springs 188 shown in FIG. 2 are stiff leaf springs with two anchors and an asymmetrical stiff lip that when compressed by the lower bracket assembly 154 closing action against the shoe assembly 152 loads the sump part against the shoe 170 to force the stops 192 to register or contact the shoe part ensuring precise control of the blade engagement with the web 128.

In another embodiment of the web cleaning cartridge 156, the cleaner sump 198 has molded grooves 230A with screw inserts 230D that can be used with proper tool blades (not shown) in a setup fixture (not shown here) to set up each sump so as to fix blade engagement and to eliminate imprecision in the locating features of the molded sump that locate the cleaning blades. Once the screws are set, they can be permanently glued in place as to not move during the operating life of the sump and to prevent any tampering with the set up. A tool blade is a hard metal piece that simulates a perfect geometric configuration of a cleaning blade. If the molded sump is well controlled during its fabrication, the above adjustable feature and set up can be eliminated along with any variability in setting up by the adjuster. Such type of screw inserts have been shown but not described in U.S. Pat. Nos. 6,901,227 and 7,031,634 by F. Ziegelmuller, et al.

Figure 4A:
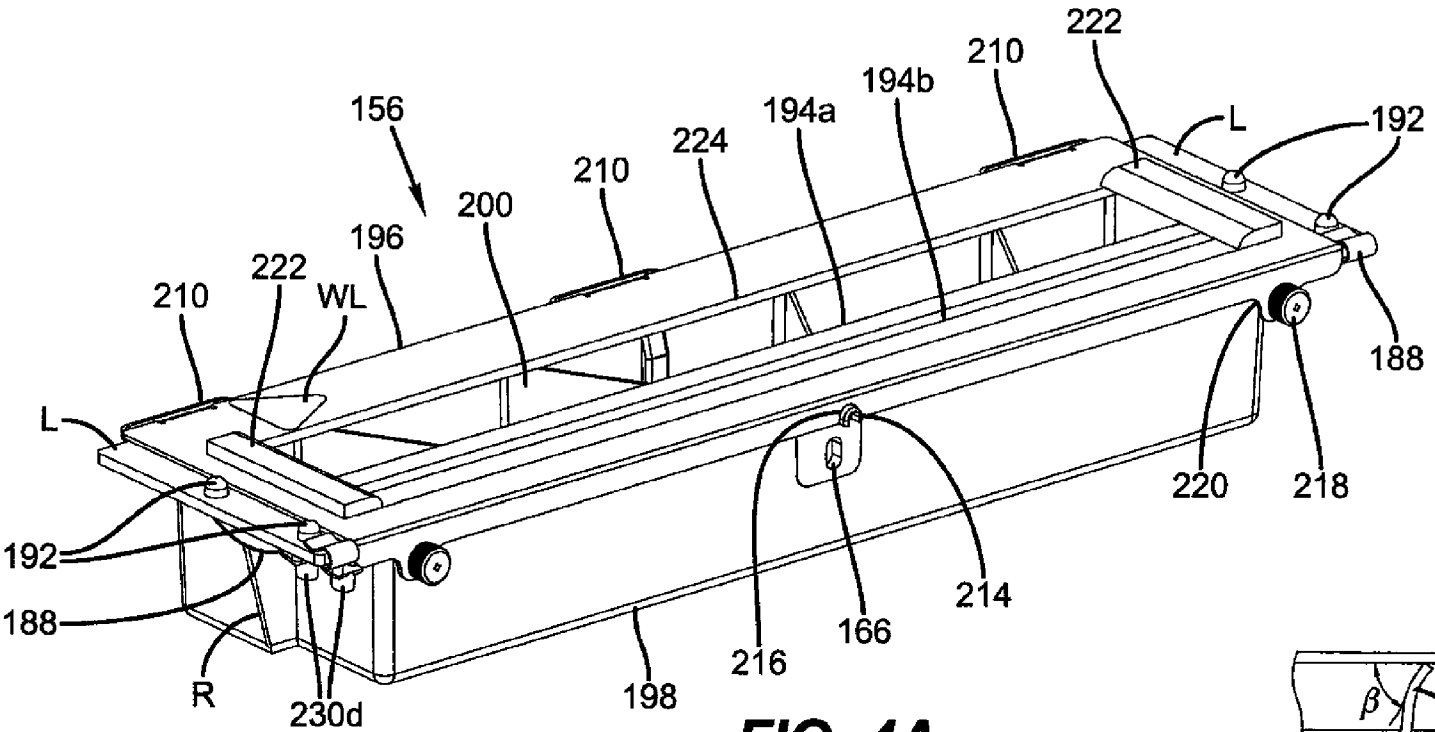
FIG. 4A is a perspective view of the customer-replaceable web-cleaning cartridge and FIG. 4B a detail of a portion of that view.
Figure 4C:
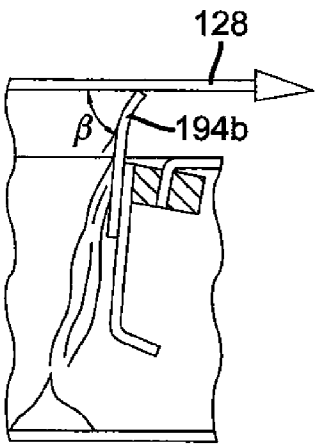
FIG. 4C shows the working angle between the cleaning blade and the web.
Figure 4B:
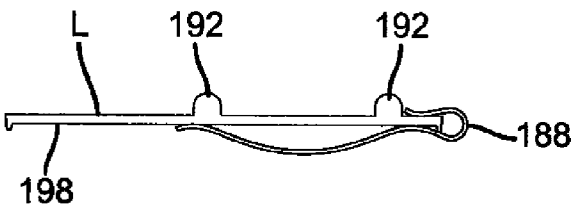

Another embodiment, as shown in FIG. 4A with detail of the end spring 188 is shown in FIG. 4B. The end spring is located at the end proximate a side of the sump. The end spring 188 is a stiff asymmetrical leaf spring with one end pushed into the side L of the molded sump as shown in FIG. 4B.

For the embodiments discussed below, it is important to have the cartridge 154 seated and locked in the lower bracket assembly 154 and to install these two components as a unit to avoid damaging the end springs 188. These springs could otherwise be damaged if the cartridge was forced into the lower bracket as the spring at rear might interfere with the flat surface 186 of the lower bracket. The web-cleaning cartridge 156 is inserted into the opening 182 of the lower bracket assembly 154 and plungers 168 on the sides of this bracket are pulled out to retract their stems ST and the lower bracket assembly and the web-cleaning cartridge are squeezed until the stems ST mate with the slots 166 on the sides of the sump 198.

The lower bracket assembly 154 with the web-cleaning cartridge 156 lockedly in place is installed into the shoe assembly 152 by inserting the notched and conically shaped pins 158 into mating the hole and slot feature 160 of the shoe assembly rear bracket, as shown in FIG. 3A-B, having cone-shaped form with circumferential notches to prevent incorrect mating of the pins 158 to the matching hole and slot feature 160 and to facilitate the assembly. The rear bracket 178 having the shield and tape assembly 179 serves to prevent the insertion of pins into spacing between the rear bracket 178 and the machine frame as previously described. It is preferable that the lower bracket assembly 154 with the web-cleaning cartridge 156 lockedly in place be inserted at an angle of 20-40 degrees with respect to the shoe assembly 152 to facilitate the mating and to prevent any damage to the cleaning blades 194A and 194B by inadvertently contacting parts on the front bracket assembly as shown in FIG. 3B. It is also important that the lower bracket pins 158 be inserted all the way against the hole and slot feature 160 in the rear bracket 178 to facilitate the proper alignment of mating features at the front of the lower bracket assembly 154 and the shoe assembly 152. The notches N on the conical pin provide a secure rest position for the lower bracket when the front is dropped from the web frame. With the pins 158 mated to the hole and slot pattern 160 at the rear, the front of the lower bracket assembly is lifted until there is a mating between the front tab features 174 and 176. As the front tab features 174 and 176 approaches one another, it is important to control the interfacing of the cleaning blades 194A and 194B with the web 128 and the hard backup shoe 170 so as to force the edges of the blade to move from right to left and thus enforcing the blades will take the correct deflection orientation which is the same orientation when the web is moving. There are several means to accomplish this, such as pivoting the lower bracket assembly 154 at the left into the rear bracket and rotating the right side into the shoe assembly 152 until it can be locked in place by a spring loaded pin (not shown here). In this disclosed embodiment, this is accomplished by adding a slanted guide feature 174*a* to the front tab 174 and a guide adaptor 177 to the front tab 176 and the guide adaptor 177 having a mating slanted guide feature 177*a* to force the cleaning blades to always engage the shoe first to the right and then be shifted to the left as the lower bracket assembly 154 is latched into the shoe assembly 152 at front. This motion of the cleaning blades from right to left reduces the chances for the incorrect inflection of the cleaning blades that can lead to edge damage, kinks or bent in metallic type of blades and it is a very important and enabling feature to the implementation of wiper blade with materials that might be easier to damage or deform permanently such as metallic blades. The latch 162 is then locked into its keeper 164. The removal process is done in reverse steps. This procedure is illustrated in FIG. 3B. In the process of closing the latch, the end springs 188 are compressed forcing the stops 192 onto the shoe and thus providing the high precision of engagement between wiper blades 194 A, B and the web 128 which is backed up by the shoe 170.

The web-cleaning cartridge 156 is shown in FIG. 4 with its two customer replaceable components, namely the cover assembly 196 and the cleaning or wiper blades 194A, B that can be metallic, polyurethane and/or have predominantly a metallic or a polyurethane material component 227 that contacts the web 128, and it is deflected due to an interference or engagement with the web to produce a working angle of β with web in the range of 40-75 degrees, as shown in FIG. 4C, and this component has a length, in a preferred embodiment, approximately equal to the width of web 128 but that is, as discussed further below in conjunction with FIG. 5-8, can have two different thicknesses, free extensions and materials to facilitate their distinguishment. The blade material component 227 is mounted on a wiper blade stiffener 228 that rests in a molded groove 230A part the sump 198 and these stiffeners have two different lengths (L1 and L2) and their corresponding grooves are also separated by these lengths so that wiper blade 194A can only be installed in the first or upstream position and the wiper blade 194B and only be installed in the second or downstream position. More details of the construction and properties of the cleaning blades are presented in FIGS. 8-12.

The wiper blades 194A and 194B are held into the molded grooves 230A by locking springs 230B and the locking spring is designed to have a thickness with a range from 0.012 to 0.018, preferably 0.015 in. on the held edge, in this embodiment to facilitate the blades installation, removal and alignment with the cover. This creates a tight alignment that also reduces noise generated by the stiffer blade during cleaning.

The web-cleaning cartridge 156 receives and store particles wiped or scavenged from the outer surface of web 128 by the blades 194A and 194B and serves not only to prevent scavenged particles from escaping through the top of the cartridge, but also acts to clean the edges of the web 128 as it passes by, and to store particles deflected from the web 128. The cartridge has a sump housing 198 with several molded features such as the slots 166, the stops 192, a cavity 200 for collecting toner from the web, integral molded baffles 202, a side L for attaching the end springs 188 by pushing the hook against the downstream side of L, slots 210A for receiving tab features 210B in the cover assembly to work as a hinge 210, an upper boss 214 to align the cover assembly notch feature 216 to the sump so fasteners 218 in the cover assembly can be attached to the threaded inserts 220 molded into the sump, best shown in FIG. 6, to lock the cover to the sump, and other molded features that will be better illustrated in FIG. 5. The cover assembly 196 has a rectangular opening O, side seals 222 that seal at the ends of the wiper blades 194, a Mylar blade seal 224 that is attached to a tab feature 226 in the cover assembly, besides other features named above, and other features that are better illustrated in FIG. 5. The blade seal 224 take many forms and materials as long as if is capable of deflecting a sufficient amount to not scavenge a toner from the web during operation.

Figure 5:
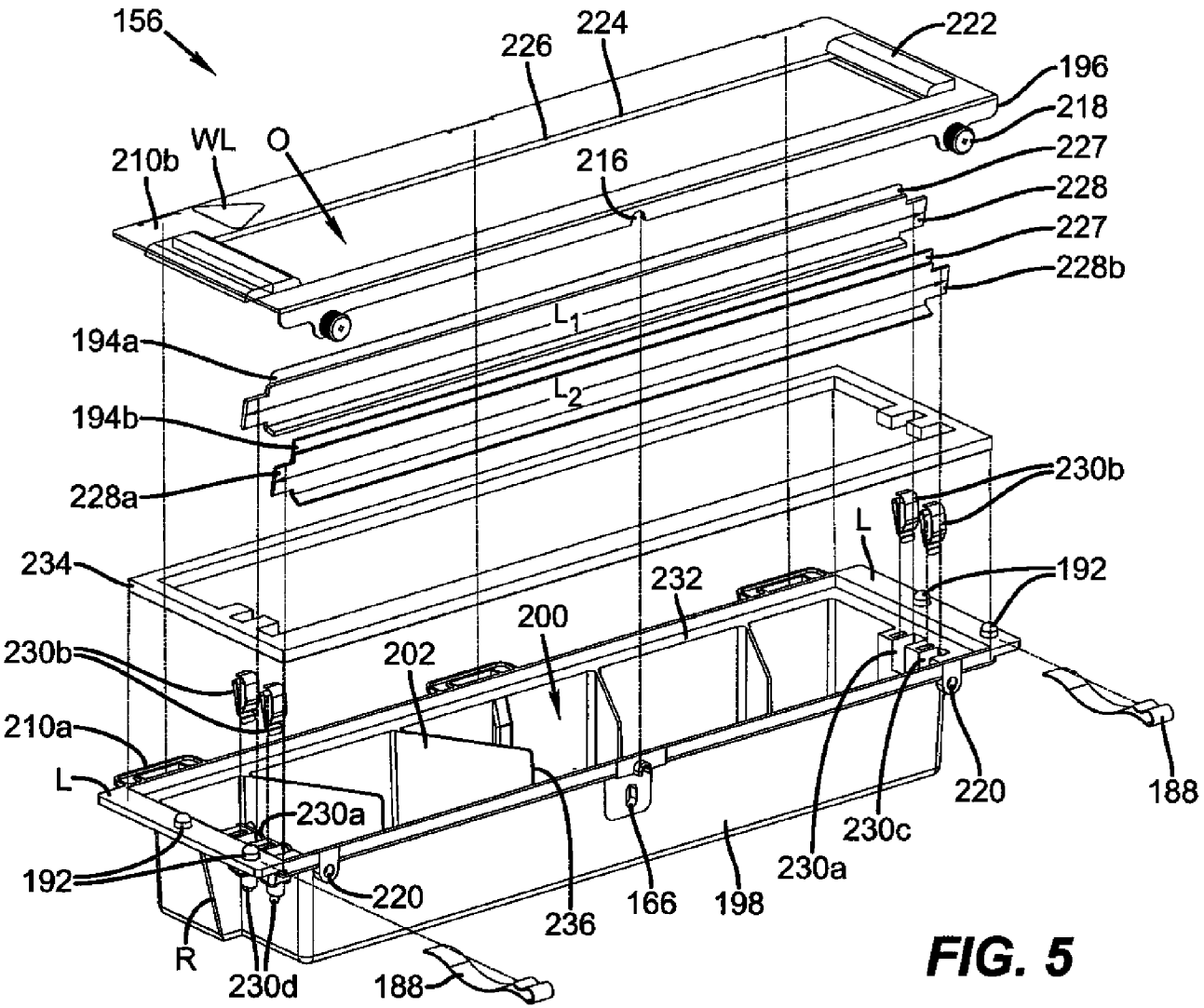
FIG. 5 is an exploded view of the web cleaning cartridge and its customer-replaceable components such as the cleaning blades and the cover assembly shown in FIG. 4.

An explosion view of the web-cleaning cartridge components is shown in FIG. 5. The cartridge is composed of the sump housing 198 which is generally a rectangular structure, defining a cavity 200, also referred to as a reservoir, with integral molded baffles 202, and one, two or more releasable wiper blades 194A,B each having a stiffener with end-piece 228A,B that is seated into a molded groove 230A at the ends of the sump and each end-piece 228A,B is locked into the groove 230A by a locking spring 230B to hold the wiper blade in the optimum location in the sump so that the wiper blades 194A,B do not fall out when inverted; and a removable cover assembly 196 to facilitate the removal of debris material from the sump housing 198 without removing the wiper blades 194A, B. The locking springs 230B are inserted into cutouts 230C molded next to the grooves 230A to form hinges 230 to lock the wiper blades 194A, B in the proper orientation. These springs have an upper lip to prevent incorrect installation of the wiper blades into the grooves. The sump housing 198 has a seat feature 232 along its perimeter that is covered by a gasket seal 234 to seal around the interface between the sump housing 198 and the cover assembly 196. The gasket seal thickness should be slightly higher than the seat height to allow for slight compression and thus sealing.

The molded sump housing 198 and components described above in one preferred embodiment are made from an injection-molded plastic having a carbon doping for static dissipative purposes to avoid excessive charge build up. Preferably, the volume resistivity of such plastic material is between $10^8$ to $10^{11}$ ohm-cm.

In the preferred embodiment these seals 222 serve both to minimize any leakage of scavenged particles out of the sides of the sump during use of the cartridge, and have an adhesive on the side facing the lid member and a wear-resistant fabric, e.g., Nylon, on the side facing the web 128. These seals minimize any leakage of scavenged particles from the sides of the sump during use of the cleaning apparatus. The foam portion of the seal needs to be of high resiliency, low density, and a low compression set to maintain a good seal and to reduce any drag torque on the transport web 128. A preferred foam material is R200/U polyester having a density of 2 lb. per cubic em. The Tricot fabric also serves to reduce friction between the web surface and the seals, and can provide some cleaning of the web surface not covered by the blades.

In another preferred embodiment, these seals 222 are made of plush material such as Acrylic fibers with a backing fabric and an adhesive layer that will face the lip surface at the ends and the plush is designed to be wrapped around the sides of the opening O. The plush seal design provides another level of robustness to damage due to web cross-track motion during web tracking corrections. The foam seal design can be torn by the edges of the web while the plush design is more robust to this type of damage. The plush seals can also reduce the load against the web.

One molded sump component shown in FIG. 3A is a rib-like protrusion R that is molded in the side of the sump housing 198 so that when the sump is placed in position by the operator these one or more rib(s) will cooperate with the lower bracket opening 182 to prevent the web-cleaning cartridge from being installed incorrectly. The cover assembly 196, that releasably attaches to the top of the sump housing 198, serves not only to prevent scavenged particles from escaping through the top of the sump housing, but also includes several features that enable easy attachment to the sump housing. Both the cover assembly 196 and the sump housing 198 include quick disconnect features which enable them to be decoupled. The cover assembly 196 has a hinge 210, that is formed by the mating of a hinge device, the tabs 210B, into the hinge receiver, molded slots 210A, in the sump housing, that can be de-coupled from the sump housing 198 to allow the debris to be easily removed when dumping the apparatus. In a preferred embodiment this device includes a hinge 210 that has a hinge receiver, in this case a slot 210A molded as part of the sump housing 198, for releasably receiving the hinge device, tabs 210B, on the cover assembly 196 to provide a pivotal connection between the cover assembly 196 and the sump housing 198. The cover assembly 196 has one or more fasteners 218. The hinge devices or tabs 210B are adapted to be readily removed from the slots 210A to enable the cover to be de-coupled from the assembly so that the cover assembly 196 is customer replaceable as shown in FIG. 6.

Figure 6:
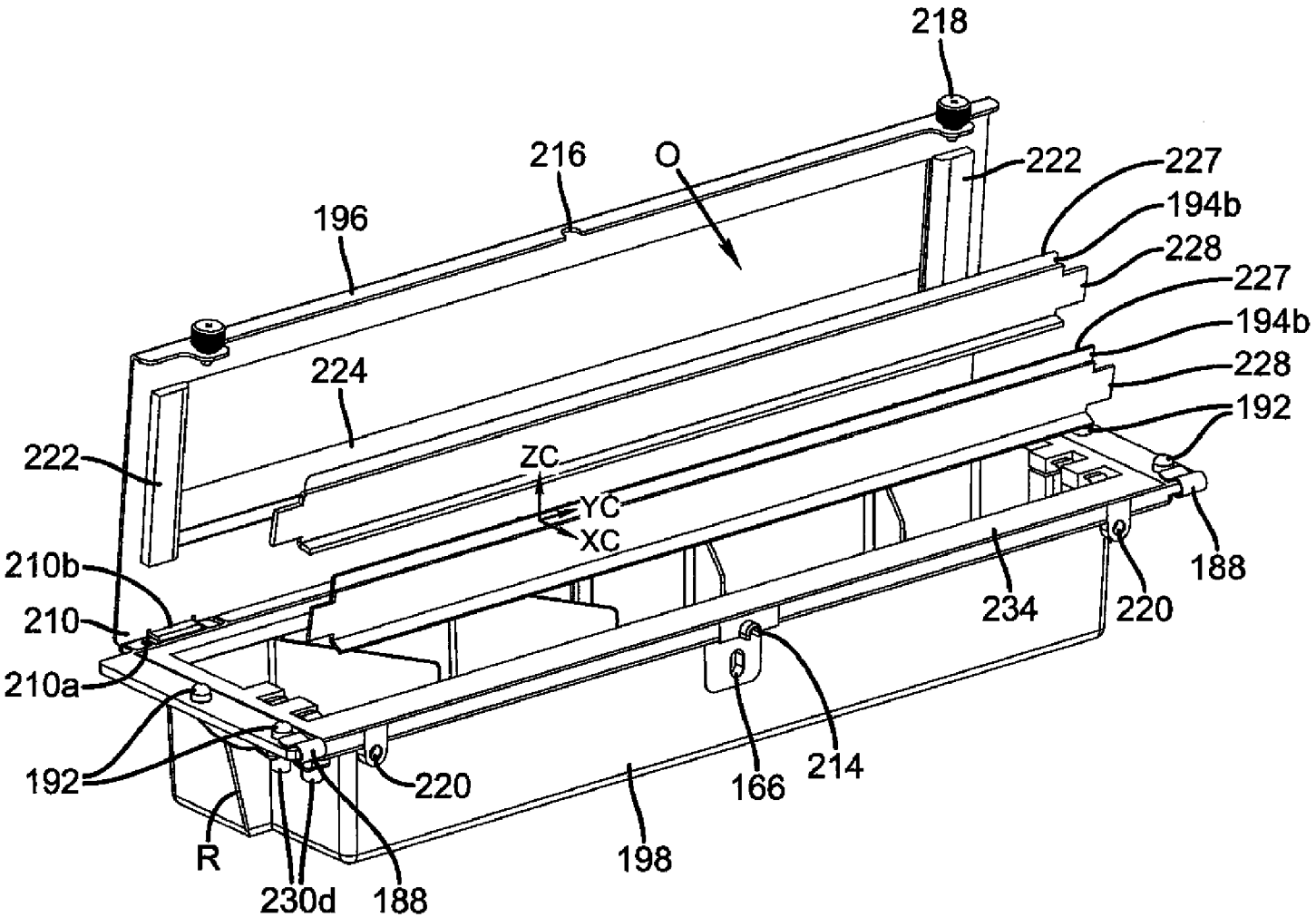
FIG. 6 is a perspective view of the cover assembly as it is being removed to allow dumping the waste toner and replacement of the cleaning blades.

FIGS. 6-7 show a preferred embodiment of the quick-disconnect features associated with the wiper blades 194A,B and specifically with the wiper blade end-piece 228A,B of the blade stiffener 228. The wiper blades 194A,B are spring biased, in relation to the sump grooves 230A, by locking springs 230B to facilitate dumping of the debris material removed from the web without removing the wiper blades or without the wiper blades dropping out when the sump is inverted to dump the debris material or otherwise be cleaned or worked on. The wiper blade end-piece 228A,B cooperate with a quick release receiver 230, which is shown as a locking spring 230B that forces the wiper blade in registration to one side of the groove 230A to define the wiper blade cleaning angle and engagement with the web, but it could be a number of releasable devices that would cooperate with the wiper blade end-piece 228 to allow the customer to quickly release the wiper blades 194A,B. Other types of releasable devices include a wedge and a fastener. This quick release receiver 230 not only facilitates the removal of debris material from the sump without removing the wiper blade but allows the customer to properly position the blade in the cleaning apparatus with respect to web 128 and can compensate for wear induced orientation changes.

The cleaning or wiper blades 194A,B (shown in FIG. 6) are adapted to contact and wipe particles from the outer surface of the moving web 128 and the sump housing 198, for supporting the cleaning blades and for receiving and storing particles wiped or scavenged from the outer surface of web 128 by the cleaning blades.

Since the cover assembly 196 releasably attaches to the top of the sump housing 198 there is the need for additional features such as one or more seals to prevent scavenged particles from escaping through the top of the sump housing, and also enable easy attachment of the cleaning blades and the cover. A gasket seal 234 is permanently attached to the perimeter of the sump seat 232 at the cover assembly-sump interface to prevent scavenged particles from escaping through the top of the sump housing. The gasket seal 234 might have some adhesive on the surface facing the sump to permanently attach itself to the sump. The gasket seal 234 could be made with plush material or foam material. The gasket seal material should have high resiliency, low density and low compression set to maintain good sealing between the sump and cover. A preferred foam material is R200/U polyester having a density of 2 lb. per cubic cm and it might have antistatic additives but other materials having similar properties might be suitable including plushes made of Acrylic, Polyester, or Nylon fibers. The cover also includes a pair of side seals, also sometimes referred to as end dust seals, 222 attached to cover and cooperating with the blades at both ends of the sump housing where the blades ends are placed in the sump. These side seals 222 serve both to minimize any leakage of scavenged particles out of the sides of the sump during use of the cleaning apparatus and to wipe particles from the sides of the web.

In a preferred embodiment these side seals 222 are made of a material that most efficiently prevents the release of dust and other contaminants from the sump housing 198. In a preferred embodiment this includes one of foam, pile, plush material, having high resiliency, low compression set and low density. In one embodiment, the side seals are made of R200/U polyester foam having a density of 2 lb. per cubic cm and having a Tricot fabric attached to the surface facing the web 128 to reduce friction and the load between the web and the seals. The Tricot fabric can provide some cleaning of the web surface not covered by the blades. In another embodiment, the side seals 222 are made of plush material such as Acrylic, Polyester, Polypropylene or Nylon and these fibers could have antistatic additives to reduce charge build up. These side seals 222 may be permanently attached to the cover assembly by having an adhesive on the surface facing the cover. It is important that these side seals have minimum gaps with the ends of the wiper blades. Preferably the gaps between the side seals and the ends of wiper blades should be less than 0.5 mm since ideally you do not want to have a gap but you cannot load the side of the blade without a gap so the gap is minimized.

Also shown in FIGS. 6-7 is a blade seal 224 spaced apart from the blades to prevent dust escaping from the space between the blades and the cover. In a preferred embodiment this blade seal 224 is a Mylar seal adjacent each wiper blade 194. This blade seal 224 can be permanently attached to the cover by having an adhesive strip matching the tab feature 226 in the cover.

Figure 7A:
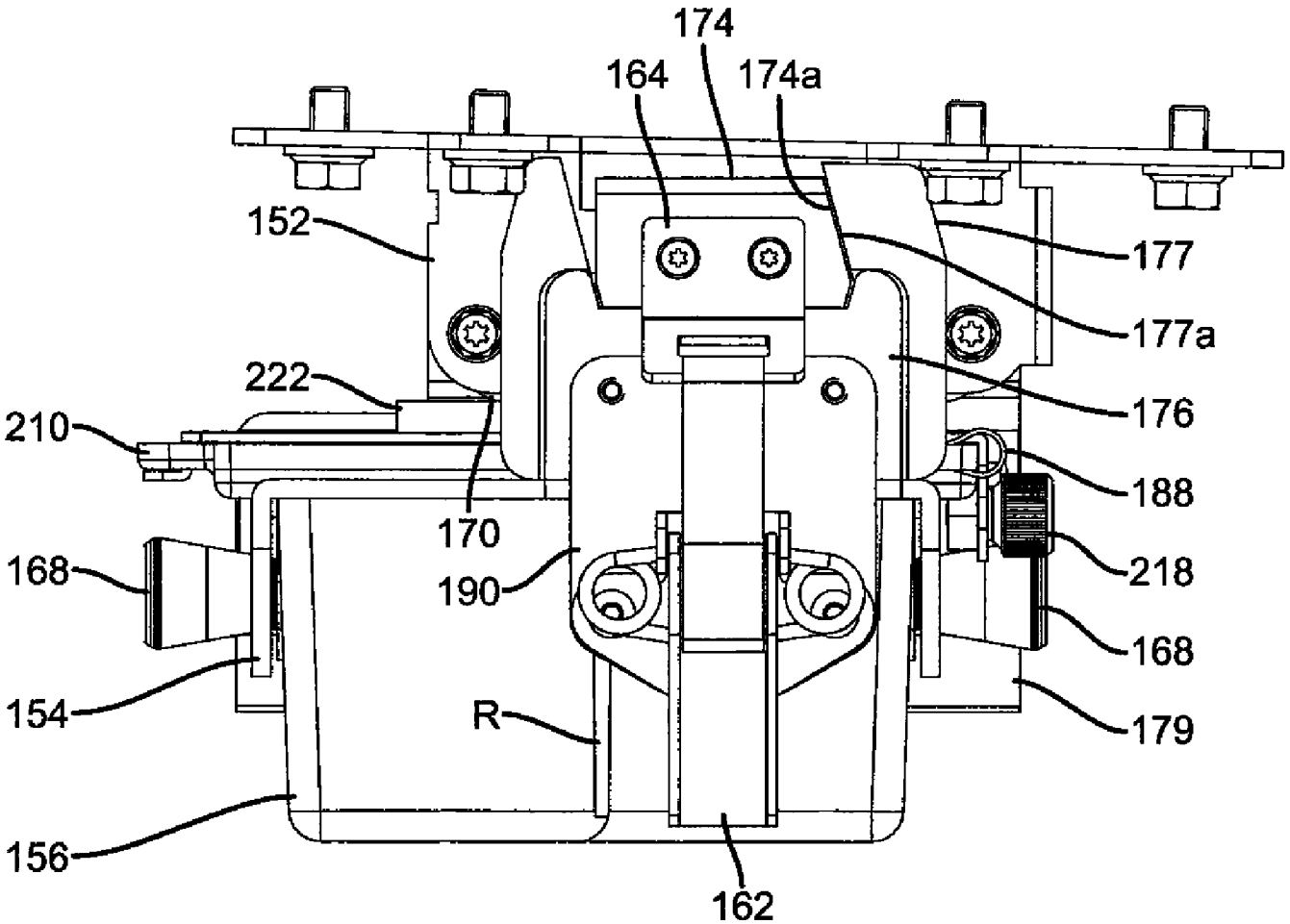
FIGS. 7A-7D are several cross-sectional illustrations of the FIG. 2 apparatus showing several important details of the interactive components of a web-cleaning cartridge and the other two major components of the apparatus.
Figure 7B:
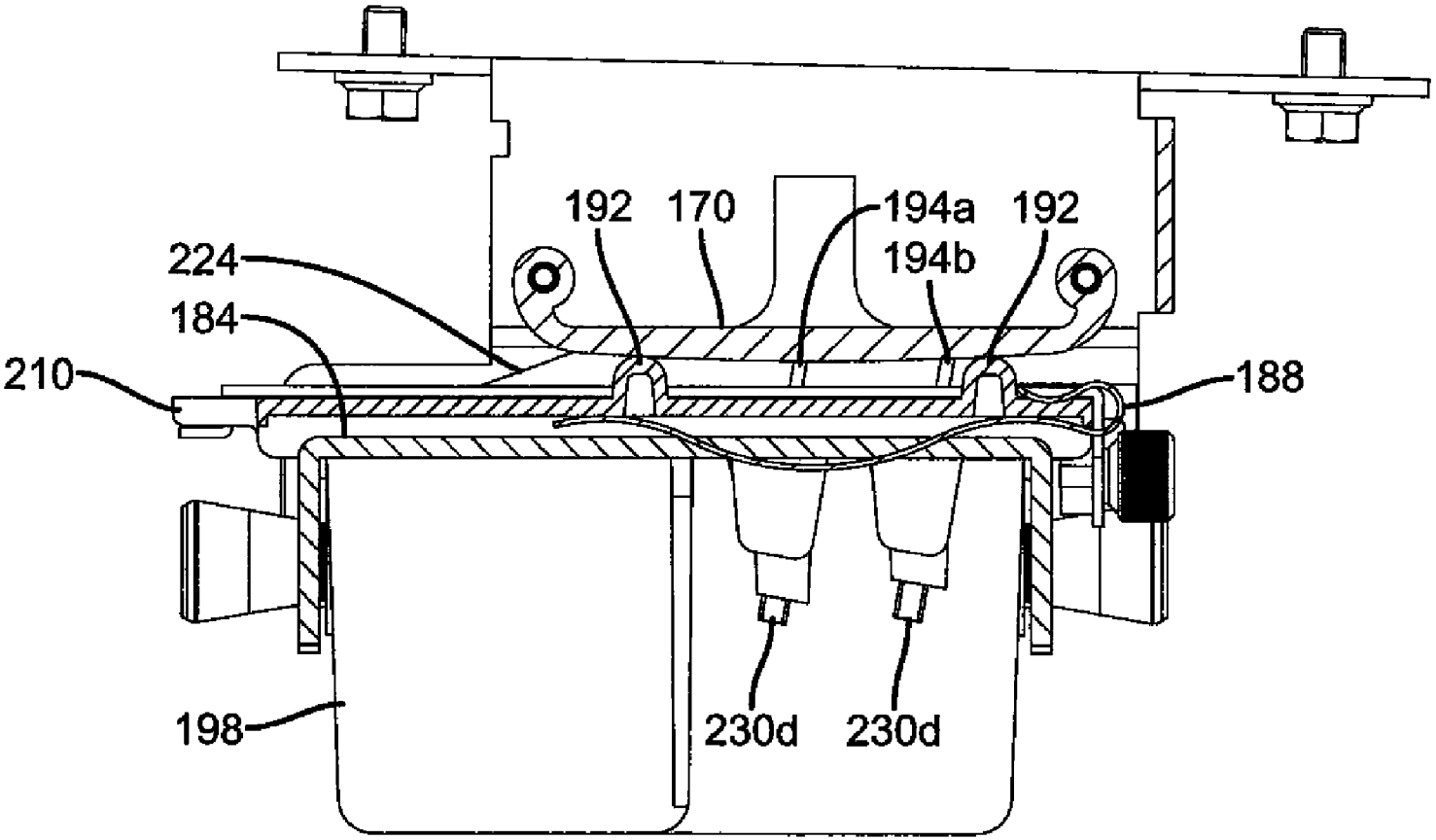
Figure 7C:
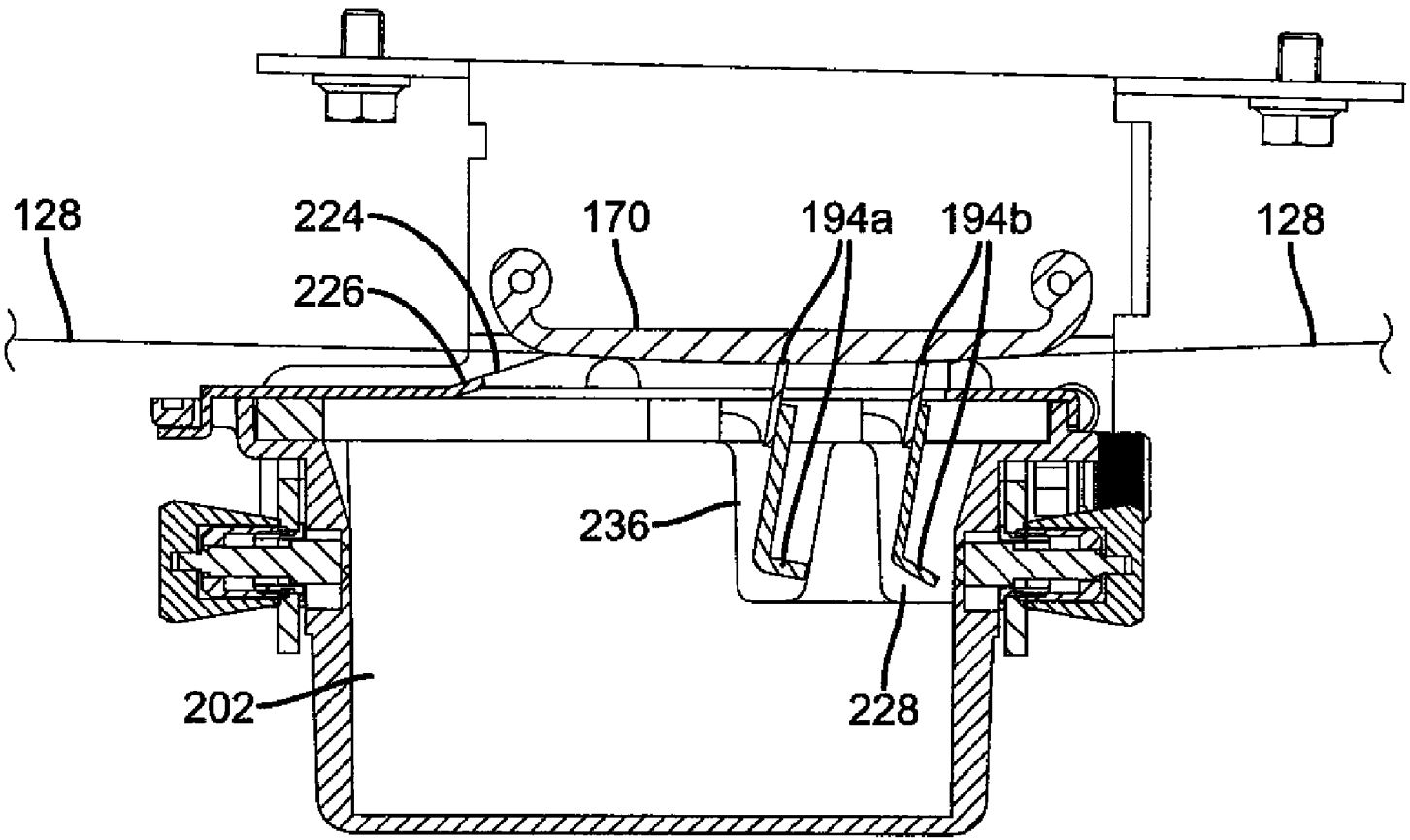
Figure 7D:
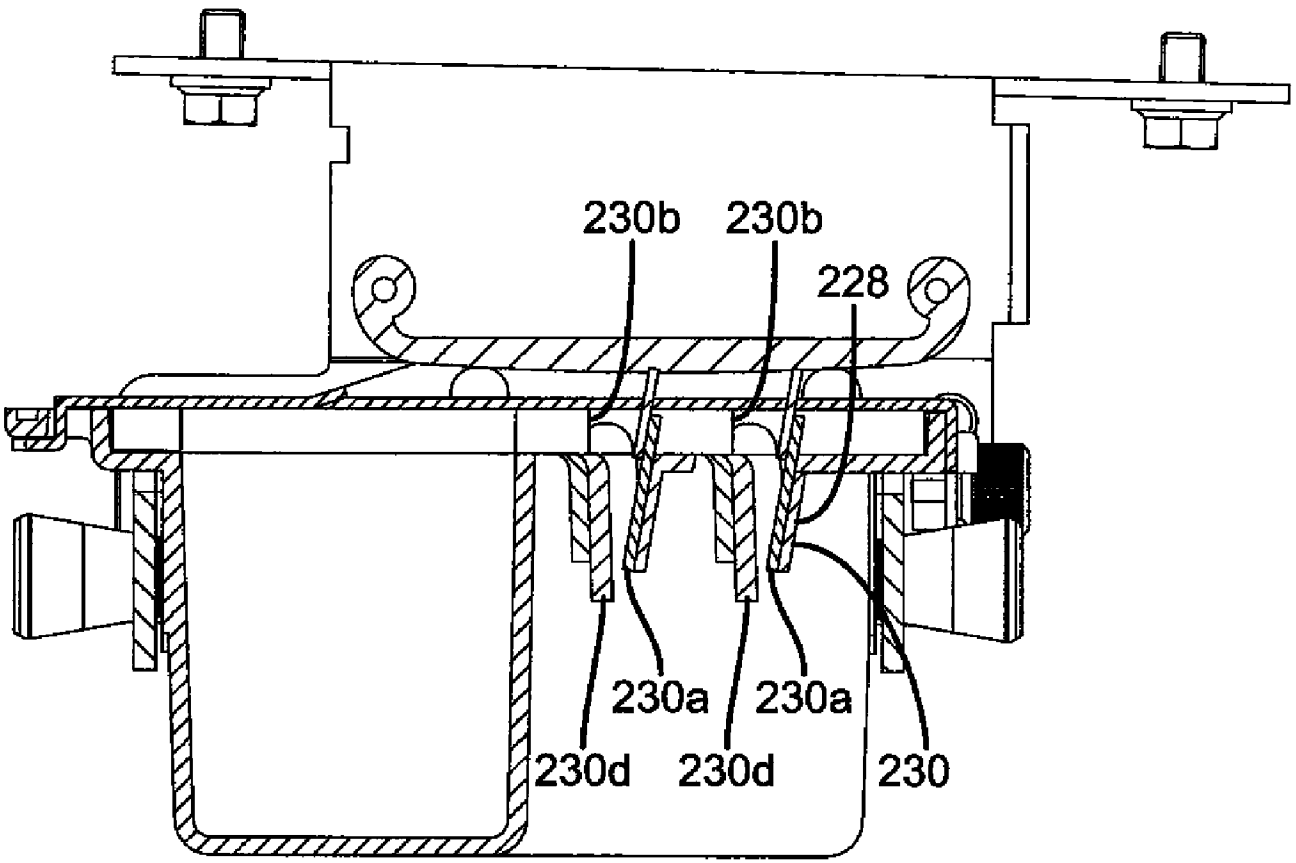

The sump housing shown in FIGS. 5 and 7C-7D includes several additional features that enable easy attachment of the wiper blades 194A,B. The molded baffles 202 in a preferred embodiment have a plurality of spaced walls that are arranged at a common angle (between about 15 and 45 degrees) relative to the side walls of the sump housing and include one or more notches 236 that prevent misplacement of the wiper blades. Baffle notches 236 are cut to model the wiper blade's asymmetric cross-section so that the operator cannot install the wiper blade incorrectly. If the wiper blade is inverted or sideways the bend in the blade stiffener will interfere with the baffle preventing the operator from installing the blade. This allows the operator to confidently replace the blades and prevent misalignments that could damage the web or reduce blade engagement with the web. The sump housing 198 also has one or more grooves 230A cut in the sump perimeter adjacent the cavity of a shape similar to the wiper blade end-piece 228*a,b* so that groove 230A and wiper blade end-piece 228*a,b* can cooperate to assure a precise fit and desired orientation of the wiper blades in the sump. In a preferred embodiment the quick release receiver can be a spring 230B that fits in the groove 230A and a cutout 230C so that the locking spring cooperates with the groove and cutout to clamp against them and hold the blade in place in such a way that the spring is biased to assure a precise fit and desired orientation of the wiper blades in the sump. This spring has also an upper lip formed to prevent incorrect installation of the blades. This allows the consumer to confidently replace the blades and prevents misalignments that could damage the web or result in poor cleaning. The double protection of the groove 230A and the locking spring 230B to accept the wiper blade end-piece 228 and the notched baffle 236 ensure precise and correct installation.

In one preferred embodiment the web-cleaning device includes a baffle 202 that is positioned within the sump housing to prevent the sudden displacement and subsequent spillage of scavenged particular material when the bracket assembly is moved to the service position during which the web-cleaning device can be removed.

The web-cleaning cartridge 156 is attached to a lower bracket assembly 154 by the retracting the stems on the side plungers 168 and pressing the cartridge into the opening of the lower bracket until the stems align with the slots 166 on the sides of the cartridge, and then installed into backup shoe assembly 152 for selectively positioning said web-cleaning apparatus 150 in a web-cleaning position in which said web-cleaning apparatus pressingly engages the web surface. The lower bracket assembly 154 and the backup shoe assembly 152 selectively positions the web-cleaning apparatus in a web-cleaning position, as shown in FIG. 3A, using shoe 170 having a hard surface adapted to contact the web surface opposite that contacted by the wiper blades and to resist the force exerted by the wiper blades and a lower bracket assembly 154 for releasably supporting the web-cleaning apparatus. The lower bracket assembly 154 is mounted to the backup shoe assembly 152 at the above-mentioned fixed location along the web path. In a preferred embodiment the backup shoe assembly 152 is permanently fixed to the web transport and is not normally moved by the customer. Alternatively, in another embodiment, the backup shoe assembly 152 can be mounted relative to the lower bracket assembly 154 to allow movement between a first operative position in which said web-cleaning component exerts a substantially uniform pressure on the web, and a second operative position in which the web-cleaning component exerts an equally substantially uniform pressure on the web 128 when the apparatus is relocated and has features that cooperate with features on the sump housing, wiper blade and/or cover to assure a desired orientation of said wiper blades in the sump cavity.

FIGS. 7A-D shows various cross-sectional illustrations of interactive components of the web-cleaning cartridge 156 with the backup shoe assembly 152 and lower bracket assembly 154.

FIG. 7A shows the front of the web-cleaning apparatus with the latch 162 mounted to a latch bracket 190. The latch bracket 190 is fixed to a front tab feature 176 of the lower bracket assembly 154. This front tab feature 176 has a mating feature that aligns with another front tab feature 174 in the front bracket of the backup shoe assembly 152.

FIG. 7B is a cross-section along the stop features 192 of the sump housing 198 and it shows the end spring 188 that is held in the sump by pressing its looped end into the side L of the molded sump. Notice the end spring 188 is shown in its uncompressed state but under the operating position, this spring is actually compressed by the action of the lower bracket flat surface 184 ensuring the stops are forced into contact with the shoe 170, and similarly the same condition occurs at the rear spring and stops, and hence the wiper blades 194A,B can be registered to contact with the web 128 at the desirable and precise engagement as shown in FIG. 7C.

In a preferred embodiment, the end springs 188 can force contact of the four strategically placed stops 192 in the sump in tight contact with the shoe 170, allowing for higher precision of blade engagement with the transport web 128. This is accomplished as the end springs 188 rest on the lower bracket flat surfaces 184 and 186 and as the lower bracket is latched at front with the backup assembly, this action causes the spring to be compressed thus forcing the sump towards the shoe until the stops prevent any further motion. By controlling the depth of the blade groove with respect to the stops and the blade dimension from the end piece resting on the groove to the blade edge contacting the web, the amount of interference between the flexible blade material component 227 of the wiper blade with the shoe can be controlled.

In another embodiment of the web cleaning cartridge 156, the cleaner sump 198 has molded grooves 230A with screw inserts 230D that can be used with proper tool blades (not shown) in a setup fixture (not shown here) to set up each sump so as to fix blade engagement and to eliminate imprecision in the locating features of the molded sump that locate the cleaning blades. Once the screws are set, they can be permanently glued in place as to not move during the operating life of the sump and to prevent any tampering with the set up as previously described.

FIG. 7C is another cross-section to show notches 236 in the baffle 202 that prevents the wiper blades 194A,B from being installed incorrectly into the cartridge and it also shows the wiper blades being held in grooves 230A by locking springs 230B and the blade edges are in precise engagement with the web 128 riding under the shoe 170. The Mylar seal blade 224 is also shown mounted to the tab feature 226 on the cover to contact the web 128 under the shoe 170.

FIG. 7D is another cross-section illustrating the wiper blade hinge 230 receiver such as locking spring 230B biasing the wiper blade end-piece 228*a-b* onto the side of the groove 230A to form the desirable angle between the blade edge and the moving web 128 that is shown in FIG. 7C.

Another molded component of the sump housing includes a slot 166 that lockedly engages the stem ST of the plunger 168 on the sides of lower bracket assembly 154. In a preferred embodiment it is important that the sump housing 198, including all its features, be molded with a static dissipating material. This is critical to prevent the unwanted build-up of static charge that would interfere with quality and efficiency during the printing process and possibly damage equipment and make the operators experience unpleasant.

One preferred embodiment of the sump has a combination of the above features, including one or more stops 192, one or more side seals 222, a continuous gasket seal 234, the Mylar blade seal 224 adjacent each wiper blade 194A,B. It also would have the end springs 188 mounted to the body at front and at rear, and said springs resting on the top surface of the lower bracket and the bottom surface of the sump housing, to provide a normal force that is distributed between the above mentioned stops 192, when the lower bracket assembly is latched at front to the backup shoe assembly and supported at the rear by the pins, to bias the stops toward the back up shoe assembly. The web-cleaning cartridge would also have baffles 202 with one or more notches 236 that prevent misplacement of the wiper blades; one or more releasable wiper blade(s) including a releasable feature, each having spring 230B, to lock the wiper blade in the optimum location in the sump so that the blades do not fall out when inverted to dump waste materials; and a removable cover to facilitate the removal of debris material from the sump without removing the wiper blade(s).

The end pieces hold the two or more releasable wiper blade(s), each having a distinguishment wherein the one or more placement device(s) to cooperate with the distinguishment to hold one wiper blade in place proximate the other wiper blade. The distinguishment is shown in FIG. 5 as two different lengths (L1 and L2) for the blade stiffener 228 or the end piece to end piece lengths wherein the L1 of the first blade is longer then L2 that is the second blade. The distinguishment is also shown as a metallic blade for the first blade 194A compared to the second blade 194B which is a Polyurethane blade as discussed above, but which could also be a metallic blade.

For cleaning of oil absorbing and/or coated web that are generally significantly more abrasive than uncoated version of the transport web, we have found that the cleaning edge of Polyurethane blades can be torn apart quite rapidly and increasing the Polyurethane blade stiffness will accelerate the damage so that fine line streaks can develop on the web surface and in particular over the same regions where the web interacts with paper and these fine line streaks are so tightly attached to the web surface that it cannot be wiped with typical Polyurethane blade material. For the uncoated web applications, there are also a few peculiar substrates or papers that have components that will deposit on the web surface and stick to it so tightly that it cannot be removed by the typical Polyurethane blade materials and these deposits also tear the Polyurethane blade edges and render these blades ineffective for the cleaning operation. In the above applications, the blade material component must be harder and more wear resistance while at the same time has controllable wear instead of the tear found with Polyurethane. While it is possible to use much harder variations of Polyurethane, a desire to arrive at a blade and coated web transport that will have considerably longer operational life blade led to an investigation into using metallic material blade component 227. The wear resistance formulation of the coated transport web coating as discussed in U.S. application Ser. No. 11/842,235 filed Aug. 21, 2007 and U.S. application Ser. No. 11/557,838 filed Nov. 8, 2006, is well suited to the application of metallic blades.

Placement of metallic materials as the blade material component 227 of wiper blade 194A in the upstream position has shown to be more effective when cleaning oil absorbing and/or coated webs that are significantly more abrasive and rougher than uncoated version of this web. The Rz, a roughness measurement describing the height from the peak to the valley of a surface and the abrasive characteristic of the web such as a Gamma-Aluminum coated belt with a particle size of 0.5 microns or less for the coated web is between 1-4 u versus typically less than 1 u for the uncoated type. The profiled metallic blade has been shown to be very effective to remove paper contamination that is stuck to the web surface and that is not effectively removed by typical blade materials such as Polyurethane blades. The upstream wiper blade is found to do most of the cleaning action. The above embodiment provides better cleaning performance when smaller toner particles are used or in an oiless or nearly oil less environment or when dealing with paper substrates that are more likely to leave a filming of paper contaminants that are tightly attached to the web transport. One skilled in the art understands that this could be achieved with one blade or cumulatively with a plurality of blades or blade segments.

Figure 8B:
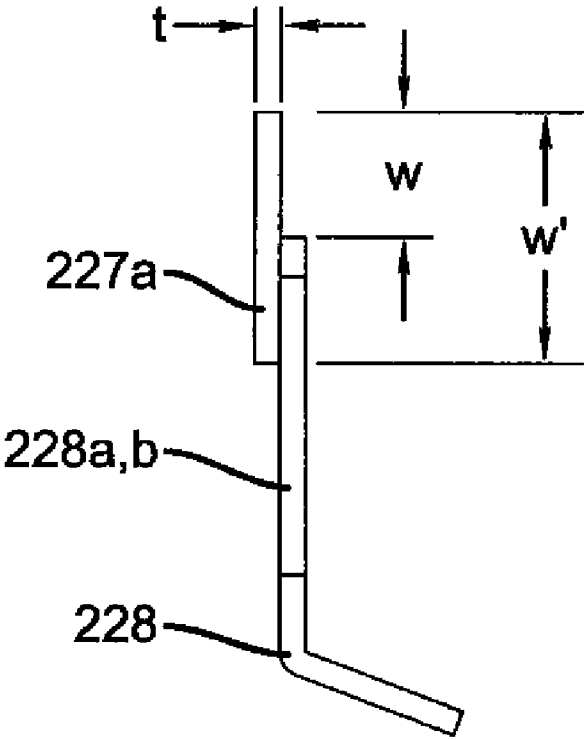
Figure 8A:
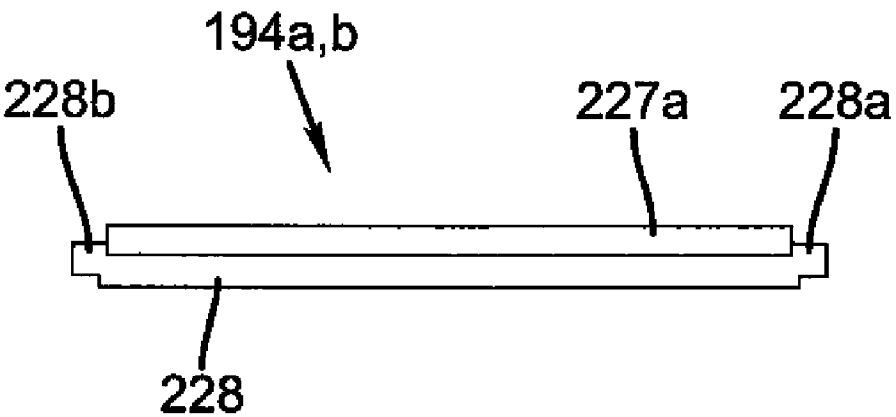
Figure 9A:
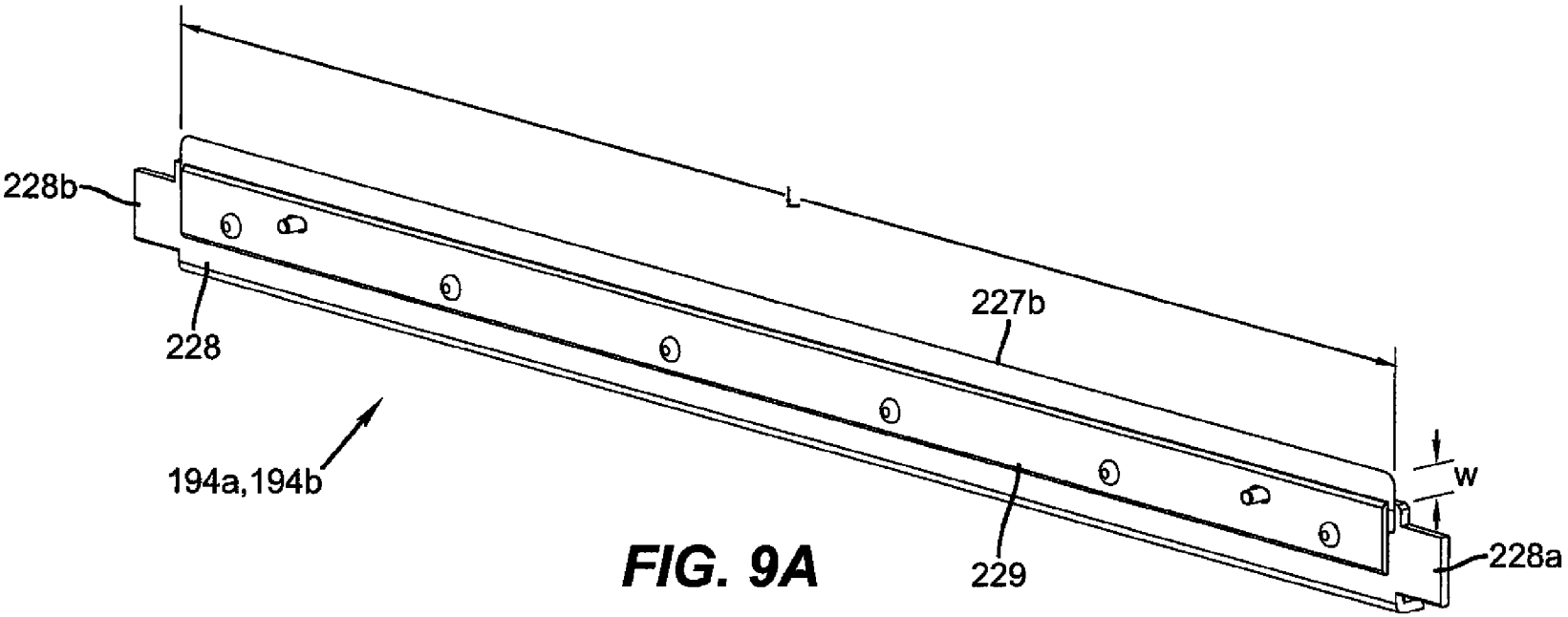
Figure 9B:
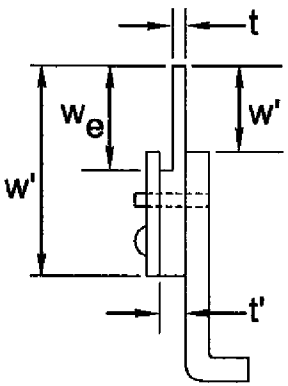
Figure 9C:
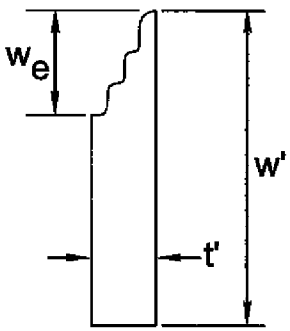

The first metallic material tested successfully was a Phosphor bronze, such as UNC C51000 per ASTM B103, with an elastic modulus of 16 kpsi with a free extension, W, of 0.250" and 0.005" thickness, t, and attached to the blade stiffener by double sided tape and at an engagement of 0.015". The blade angle with the web was close to 80 degrees in the undeflected state. The blade material component had been made of uniform thickness profile as shown in FIGS. 6 and 8A-B using photoetching process. The ends of the Phosphor Bronze blade were rounded to a radius of 2 mm to avoid a sharp corner. For the corners of the metal or metallic blade, it is recommended a radius of 1-5 mm. This blade was installed as the first blade and the second blade was that of a typical Polyurethane blade material of uniform thickness profile as shown in FIGS. 6 and 8A-B, with 0.050" thick, 0.250" or 0.050" free extension and elastic modulus close to 1000 psi at close to 0.015" engagement.

A typical cleaning blade of uniform thickness profile is shown where 227A may be either made of a metallic material or a polyurethane material, with a free extension W, total width of W' and thickness t that is glued to a steel blade stiffener 228 having end-pieces 228*a,b* is shown in FIG. 8A-B. This combination of cleaning blades 194A and 194B was tested against a coated web that had developed the hard to remove fine line streaks on the coating and fine line streaks on prints and within a couple of web revolutions, the web and prints were free of contamination and it was tested for over 65000 impressions without failure while the original combination of Polyurethane blades were failing within 1,000 to 4,000 impressions. Another combination of Phosphor bronze with a free extension of 0.500" and the same thickness and engagement with a similar Polyurethane blade in the second position was used to test an uncoated transport web after it had become contaminated with paper residues that the Polyurethane blades were not able to remove and this combination of the metallic blade and Polyurethane blade removed the web build up within a few web revolutions. Other variations of metallic blade materials and having different thickness profiles as shown in FIGS. 9A-C, FIG. 10 and FIG. 11 can be generated through a photoetching process. This process was tested on spring steel, stainless steel of various hardness (AISI 301¼ to full hard, and other grades of Stainless Steel), and preferably with low residual magnetism to reduce attraction of magnetized carrier particles, amongst the materials tried were Spring Steel C1095 with high residual magnetism and Stainless Steel AISI 302, but other metallic materials might work as well but may have different wear rates. In one example, a metallic strip 0.005" (t') was etched down to 0.0025"-0.003" (t) for the stepped profile like that shown in FIG. 9.

In another example both a 0.0025" and a 0.003" (t) strip would break the uniform thickness profile, as shown in FIG. 8, with a free extension W of 0.200-0.275" and having a total width W' around 2 times that of W, with an engagement from 0.010" to 0.035" with the web. This was found to be very successful at cleaning the hard to remove contamination that builds up on webs when using only Polyurethane blades. For the stepped profile, the etched side surface can be processed to generate an etched width, $W_e$, that can be shorter than the free extension W for a stiffer blade configuration or longer than W for a less stiff configuration. In fact, the coated web was able to sustain wear from the metal blade for over 200,000 impressions and the metallic blade components in some cases have maintained good performance for over 600,000 impressions when the material component was Spring Steel or Stainless Steel. Furthermore, the metallic blades allow for cleaning of process control patches and registration marks even when not discharged by the web conditioning charger 144 and this may allow placement of this charger in the post web cleaning zone if needed. This can be an important feature as cleaning of patches from the web usually leaves a residual charge pattern on the web at these patch locations and the non-uniformity in web voltage or charge pattern might lead to patch disruption or other non-uniformity in the images that must be addressed by a tackdown charger corona charging station 138. The present invention thus can be useful when using a metallic blade material having low residual magnetism to reduce attraction of magnetized carrier particles to the cleaning edge of the blade. Based on the test results, several embodiments of the wiper blade 194A, B can be proposed. One embodiment would have only one metallic blade and this could be placed in the downstream position so there are no further changes needed to the web cleaner cartridge.

Figure 10A:
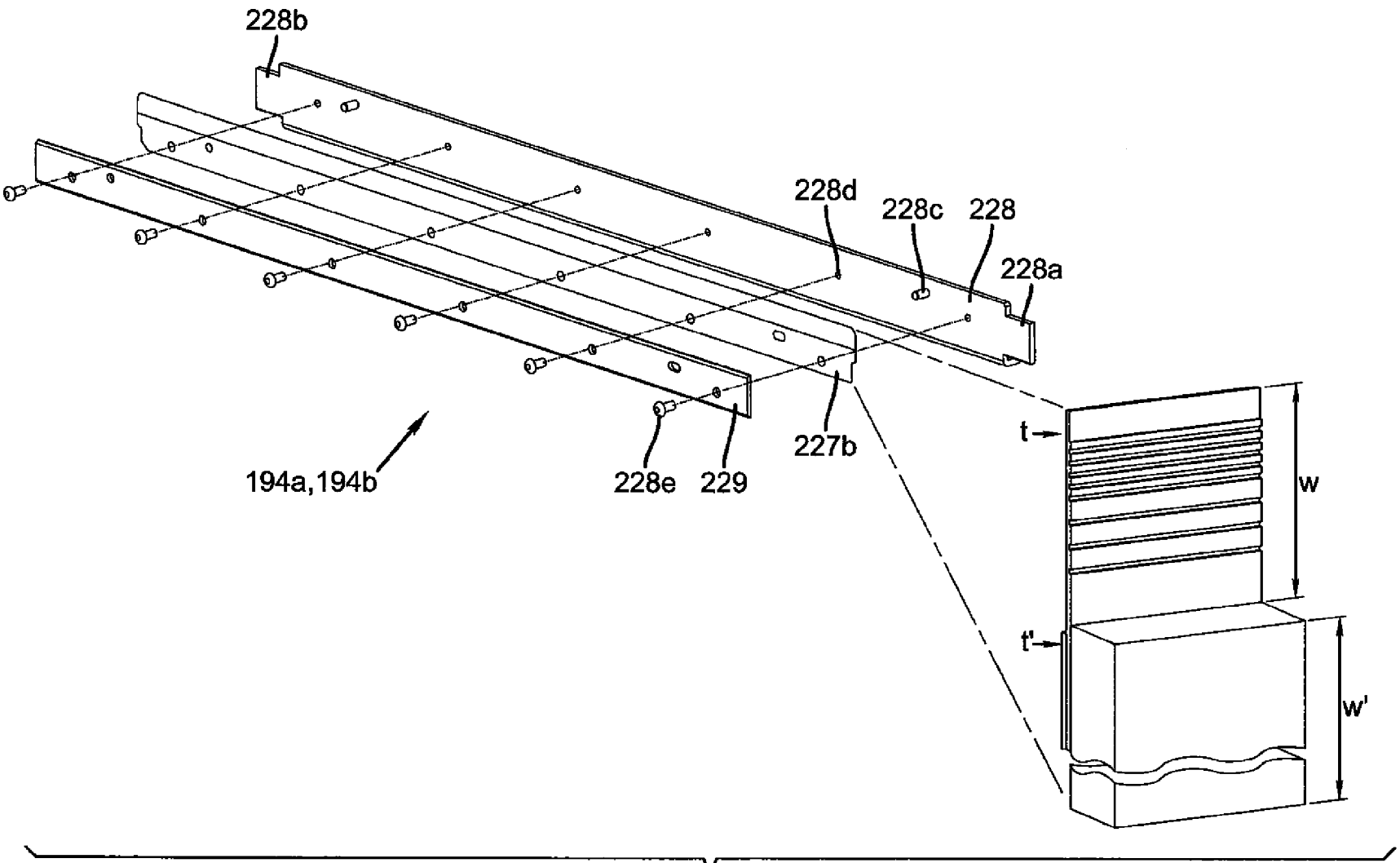
Figure 10B:
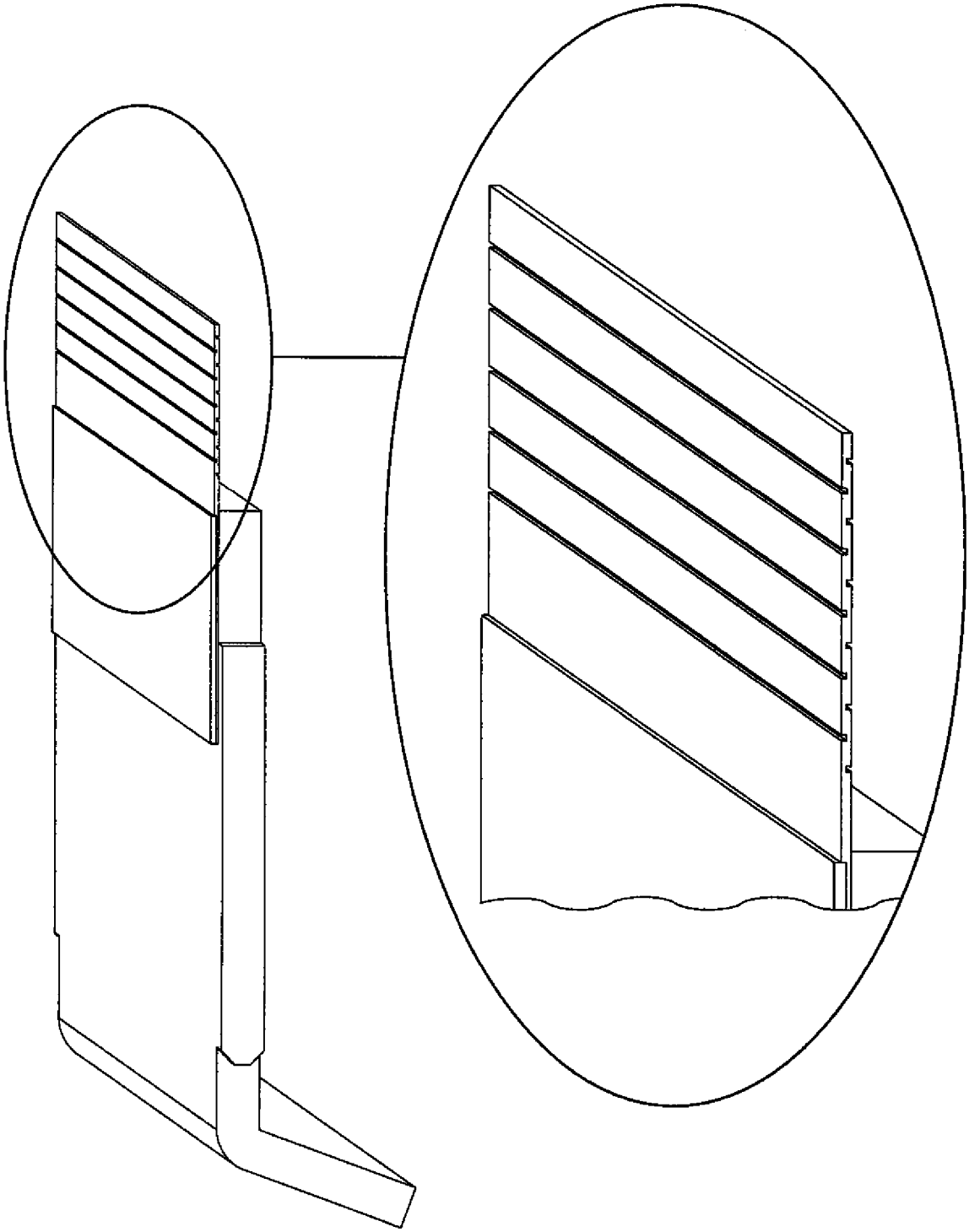

Another embodiment of the profiled metal blade that was made and tested had ribbing as shown in FIG. 10B. The blade shown is a dual etched profiled metal blade that is etched on both sides in order to reduce the beam stiffness. The width of the blade and the number, the profile and the dimensions of the grooves can be adjusted to achieve the specific stiffness and performance characteristics desired. The profiled blade shown image is etched from both sides to allow the profiled blade to be tapered or ragged on both the front and back and scaled to work with the desired contact force. The profiled blade could be also be made with an etching on only one side as described in more detail above. This one-sided etching might not be able to satisfy the demands of all cleaning situations so the two-sided etching is a different embodiment.

Another embodiment would have a metallic blade as the first blade 194A and a Polyurethane blade as the second blade 194B and a third embodiment would have two metallic blades so a small defect on the cleaning edge of one blade might not degrade cleaning performance as it is unlikely both blades would have a edge defect in the same location. If two blades are used, they could have the same stiffness/unit length or preferably a stiffer blade in the first position and a less stiff blade in the second position. Furthermore, the metallic blade component could be of uniform profile or thickness 227A or of a variable or stepped thickness profile 227B as shown in FIG. 8-12. The metallic blade component 227 can be mounted to the blade stiffener 228 through a blade holder 229 using precision locating pins 228*c* and locking bolts 228*e*. The locating pins 228*c* would facilitate the mounting of the metallic blade and it sets the precision of the blade mounting for determining the tree extension along with the blade holder 229 and for the engagement with respect to the stiffener end-pieces 228*a,b*.

Figure 11:
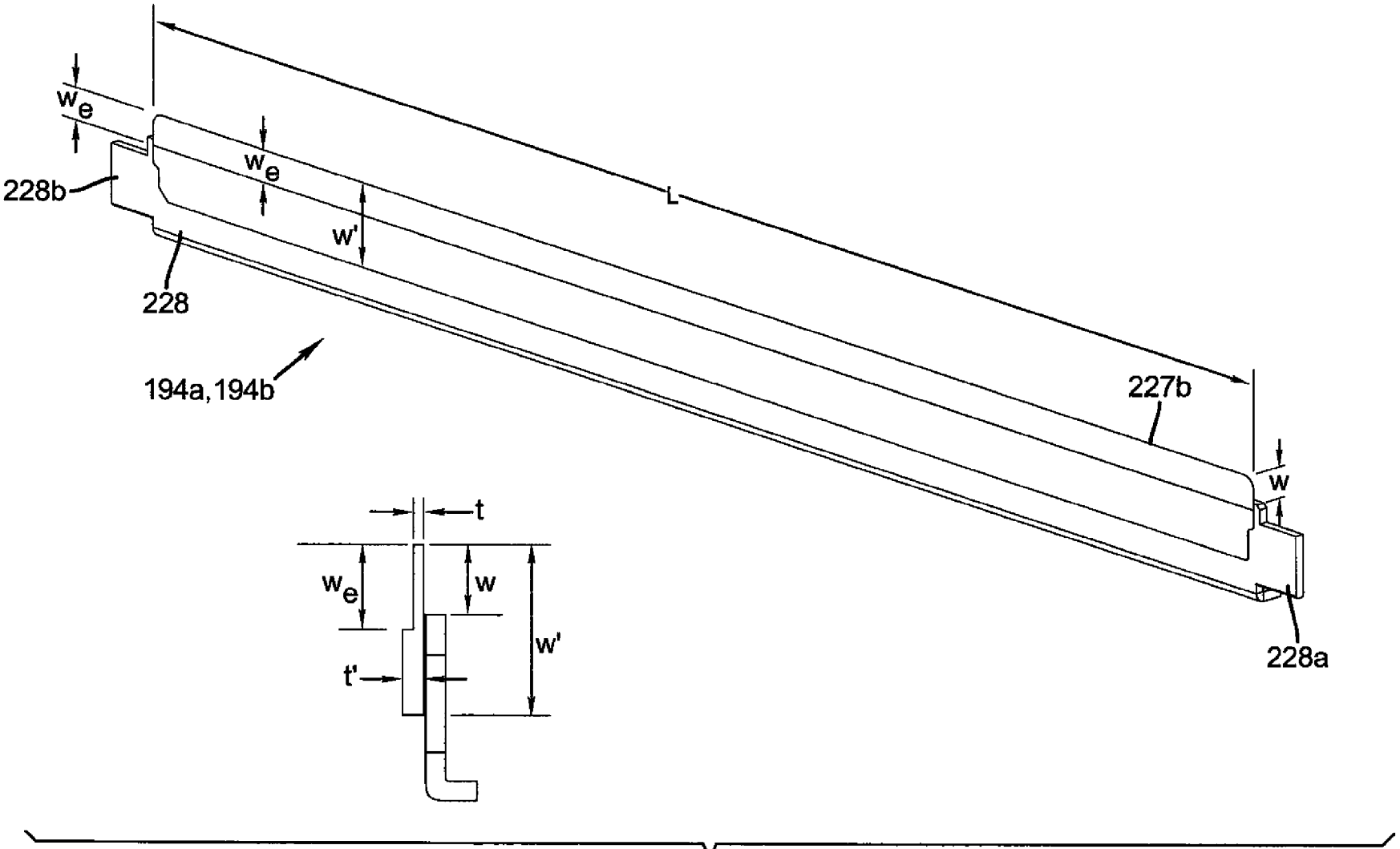

Other clamping techniques and configurations of mounting for blade component 227A or 227B can be used to accomplish the same task as shown in FIG. 12. In another embodiment, the metallic blade component can be glued to the blade stiffener similar to the glue operation usually done for Polyurethane blades as shown in FIGS. 11 and 12 and this technique reduces the number of parts and assembly time.

In a preferred embodiment the ends or corners of the metallic blade material component 227 are rounded to avoid a sharp corner and typically the radius should be 1-5 mm. Due to the thin nature of profiled metallic blade component and the edge sharpness as a required for functionality, warning labels WL are placed on the cover assembly and can also be added to each metallic blade assembly to warn the operator to carefully handle this blade and its edge. The metallic blade is also more susceptible to permanent deformation, kinks and damage so it must be handled with care.

Stiffness is measured by (E*L/4) (t/W)^3, where E is the elastic modulus of the blade material, L, t, and W are the blade material component 227 length, thickness and free extension in contact with the web so thickness is one of a number of ways to achieve a stiffer blade, any of which could be used. The tree extension W is usually the distance from the end of the blade that will contact the surface to be cleaned to the fixed end of the blade that is held by the blade holder. For stepped thickness blades or variable profile blades, an equivalent stiffness can be calculated based on the variable profile of the thickness and the free extension or the clamping conditions through Finite Element Analysis. Note that this simple beam calculation is for an evenly clamped support on both sides of the blade. If the constraint of the blade is clamped unevenly and depending on which side of the stepped beamed is facing the blade holding support bracket, it will affect the stiffness. In these cases the finite element analysis can be used to calculate the effective stiffness due to nonlinear clamping of its boundary conditions. Since metallic materials have considerably higher elastic modulus, they need to be considerably thinner than Polyurethane blades. For Polyurethane blades, the range of stiffness/unit length is selected in the range of 2-5 psi and for the preferred embodiment of the metallic blade; the stiffness/unit length can be from 2-32 psi, and best in the 2-16 psi. For one of the proposed embodiment, the uniform thickness profile can be in the range of 0.002-0.0035" with a free extension of 0.200"-0.350" and an engagement in the range of 0.010" to 0.035". The stiffness/ unit length is selected to control the torque load imposed by the cleaner on the moving web and the load force or engagement needed to arrive at an acceptable and long lasting cleaning performance. Blade hardness will also play a factor in the torque load and blade wear and stiffness as the elastic modulus can be derived from it. The stiffener plate is selected with a lower leg bend to increase stiffness to reduce bowing and vibrations. With the introduction of stiffer blade, noise and vibration of the cleaner and web can ensue and that can lead to blade edge damage. To reduce the noise and vibrations, we can increase the stiffener thickness, add embossment to the flat portion across its length, elongate the lower leg, add a center support point and also change the thickness of the locking springs as discussed earlier. Some of these techniques are implemented in this cleaner but not shown here.

Due to the stiffer blade selection for the metallic or even if a higher stiffness Polyurethane blade is selected, the wiper blade 194A, B load onto the shoe assembly along with the loading from the stops 192 can be high enough to generate a bowing or deformation on the shoe away from the blade that can reach in some cases 0.005-0.010" and this would reduce the effective blade engagement across the blade length and may lead to poor cleaning as the metallic blade wears. To resolve this problem, a preferred embodiment of the shoe 170 is that of an extrusion or machined part of high enough rigidity to reduce the above deformations to a level below 0.003" and in this case a "T-shaped" extrusion is selected as shown in FIGS. 2-3.

In a preferred embodiment the Polyurethane material for the wiper blade can be made from polyester polyurethane with the following properties: a hardness of between 60 and 85 Shore A, an initial (or Young's) modulus of between 500 and 1500 psi, a Bayshore resiliency above 30%, and a compression set lower than 25% as is described in the aforementioned cross-referenced U.S. Pat. No. 6,453,134, issued on Sep. 17, 2002, in the names of Ziegelmuller et. al., the contents of which being hereby incorporated by reference herein. The two cleaner blades could involve other extinguishments such as a first blade being a metallic blade which has higher stiffness than the second blade which is also a metallic blade and their respective blade holders are of different thickness so that the placement of the blades is easy for an operator to distinguish.

In one embodiment of the toner removal apparatus for cleaning particulate material from a moving surface in an electrographic printer that is adapted to contact the surface to remove particles from the surface has two or more releasable wiper blades. At least one of the releasable wiper blades is a profiled metal blade for example a first blade that is closest to a first cleaning contact point. A holder having one or more placement devices cooperates with the profiled metal blade to hold the blade in place proximate a surface at a working angle of 40-75 degrees for cleaning particulate material from a moving a surface. In one preferred embodiment the profiled metal blade has a stepped thickness profile. The stepped profile thickness can have an etched profile as discussed above. Specifically the etched profile could range between 0.002" to 0.003" on the contact edge, 0.005" on a held edge, with a free extension for the etched profile of 0.250" and the stepped down thickness ranging from an extension of 0.180" to 0.325" from the contact edge. The image on the right could also be made by etched from both sides therefore be tapered or ragged on both front and back and scaling to work via the desired contact force. In another embodiment for wear rates up to 6000,000 papers an engagement of 0.015 to 0.035. Note that the beam length is the free extension and not the L in K/L where L is the length of the blade needed to clean across the web.

The stepped profile can have a width narrower than the blade free extension for varying the stiffness/length ratio for the blade. The varying stiffness can be designed to effectively clean a movable web surface, coated or uncoated, having a Rz, roughness between less then 1 to 4 microns as well as a coated Gamma-Aluminum web having abrasive particles size of 0.5 microns or less. The profiled metal blades can have one or more rounded corners with a radius of 1-5 mm to enhance cleaning without damaging the web. The apparatus can have two or more blade holders so that the holders enable a free extension of 0.200"-0.350" and an engagement in the range of 0.010" to 0.035". The stepped thickness profile can be held at the thickest portion of the blade so that a thinner thickness profile extends beyond the free extension to reduce the blade stiffness and/or a thinner thickness profile shorter than the free extension to increase the blade stiffness. The blades can be one or more metal blades and/or one or more polyurethane blades having a stiffness/unit length from 2-5 psi and one or more metallic blades having a stiffness/unit length from 2-16 psi, and an uniform thickness profile between 0.002-0.0035". For example the two cleaner blades could include a first metallic blade closest to a first cleaning contact having a higher stiffness than a second metallic blade, such as a stiffness/unit length, K/L of 2-32 psi. The second blade could alternatively have the same stiffness and/or a lower stiffness. In another embodiment, there might be only one metallic blade which seats in the second position and has the required properties to maintain good cleaning performance.

In other embodiments the first blade has a longer length discussed above can act as a distinguishment and locator since the longer blade would not fit in the shorter position. Other changes, such as matching keys, can be used to prevent mis-location of the blades. Note that either the metallic or the polyurethane components can be attached to the blade stiffener through permanent glue and for either edge can be used as the cleaning edge.

When a first blade is stiffer it allows the removable of tough materials from the web than the second blade less stiff blade. For the metallic component blade either of uniform thickness 227A or profiled thickness 227B, the stiffness/unit length, K/L, has been found to be best in the range of 2-16 psi, but it can go up to 32 psi. In the profiled metallic blade, the material can be photoetched to generate a desirable profile as shown in FIG. 8B, starting with a material such as spring steel, stainless steel, phosphor bronze or other metallic materials having higher hardness up to full hard. Masks are used in registration on both sides of the sheet of the material which is then immersed in an acid bath under controlled conditions to generate either a component that is in general rectangular in shape and uniform in thickness 227A to one having a step profile 227B as shown in FIG. 8-11 to arrive at a desirable thickness and free extension that yields a stiffness within the desirable range described above. The quality of the cleaning edge is very important, as the edge needs to be sharp and uniform. The blade material component that comes out of the photoetching process might require further treatments to improve edge quality. Photoetching from both sides to generate a uniform thickness profile usually leaves a cusp at the center in the thickness direction (FIG. 12) but the adjacent edges are sharper or have smaller radius and the thickness of the metallic blade is very well controlled. The process of generating the two step thickness profile requires masks of unequal size on the metallic sheet that leaves no cusp but the edge on the surface side that has been etched is usually not as sharp as the adjacent edge (FIG. 12) and the process must be well controlled to maintain uniform thickness and good edge quality. In either cases, when the process is well controlled, good edges are achieved that can produce good cleaning performance. Other manufacturing methods for fabricating the metallic blades are possible including shearing, grinding and polishing to generate square edges or electropolishing to round the edges. The edge should have a radius of less than 10 u, preferably less than 5 u, but given the more controlled wear of a metallic blade against the coated transport web, the edge radius should become sharper with use. For the Polyurethane blade component, the K/L should be within the range of 2-6 psi but given the higher roughness in terms of Rz, a roughness measurement term estimating the height from the peak to valley of a surface, of the coated web, the edge quality of the Polyurethane will quickly degrade with usage and thus another embodiment of the disclosure is to use two metallic blades which can be made to have the same K/L or different K/L to reduce the loading effect and wear on the coated web.

Other manufacturing methods for fabricating the Metallic blades are possible including shearing, grinding and polishing to generate square edges or electropolishing to round the edges. One such method of shearing a metallic shims and producing what is called in the trade as "edge number 3" than can produce a rounded and a sharp edge of good enough quality for such blade cleaning applications. The edge should have a radius of less than 10 u, preferably less than 5 u, but given the more controlled wear of a Metallic blade against the coated transport web, the edge radius should become sharper with use. The sheared edge #3 edge quality was tested for IC/BC conductive brushes and successfully cleaned metallic detone rollers for 750-2.2M prints.

One skilled in the art will understand that this apparatus can allow the lower portion of the sump body to engage the lower bracket assembly in such a way that the assembly prevents the operator from removing the sump assembly incorrectly, thus causing damage to the end springs and other components, or inserting the sump assembly incorrectly. The sump can be removed by pulling out the stems on the plungers on the sides of the lower bracket. In one preferred embodiment this safeguard requires the operator to remove the lower bracket assembly with the sump assembly as a unit for servicing such as dumping waste, replacing customer replaceable wiper blades or cover assembly, or vacuum cleaning the cover especially around the end seals.

The lower bracket assembly is pivotally mounted to one end of the back-up shoe assembly to enable the cleaning apparatus to be moved between an operative position (shown in FIG. 1) in which its cleaning components engage web and press against the backup shoe, and a service position (shown in FIG. 3B) in which the web-cleaning cartridge and lower bracket assembly as a unit is sufficiently spaced from the web to enable it to be removed for servicing and/or replacement.

The cleaning apparatus allows a method for assisting a customer in removing a web-cleaning apparatus adapted to contact a surface of a moving web and to remove particles from the web with a quick release device to be greatly simplified. The customer will first release the latch at the front of the lower bracket from its latching keeper at the front bracket of the backup assembly and then remove the lower bracket assembly with the web-cleaning apparatus. The latter can then be placed on a table for further servicing. For servicing the web cleaning apparatus, the customer will remove a releasable cover component by first loosening the fasteners on the cover and then rotating the cover out of the upper boss in the sump and about the hinge/slot features of the cover and sump and then pulling the hinges out of the slots. This enables the cover to be physically de-coupled from the sump and/or lower bracket to facilitate the removal of debris material from the sump without removing the wiper blade(s). The operator might prefer to remove the web cleaning apparatus from the lower bracket and this can be done by pulling the plunger out to retract the stem on the side of the lower bracket to disengage the stems from the slot features on the sides of the web-cleaning cartridge and this operation which enables the lower bracket assembly to be physically de-coupled from the sump thereby facilitating assembly or web service and/or replacement. Then a releasable wiper blade component including an end piece and distinguishment that locks the wiper blade in the optimum location in the sump so that the blades do not fall out when inverted but is releasable from the sump and cover to facilitate the removal of debris material from the sump after removal of the wiper blade(s) or for replacing the customer replaceable wiper blades. While the wiper blades are releasable from the cleaner, the thin nature and sharpness of the metallic blade requires special attention by the operator and a warning label WL is placed on the cover of the cleaner sump and each metallic blade to avoid any cuts or scrapes with the blade edge.

If the customer is using a preferred embodiment discussed above, the customer will only have to remove the lower bracket assembly with the web cleaning apparatus as a unit. This avoids damage to the end springs by too much handling of the apparatus from the operator and provides the customer a number of additional safety features. These safety features are based on the fact that if the web cleaning apparatus were easily replaceable then when the operator were to install the spring loaded cleaner, the springs at rear could interfere with the lower bracket feature at the rear and this might lead to damage to the spring, or sump feature that allows the attachment of the spring to the sump.

The customer should be able to remove the cover assembly and then invert the lower bracket with the sump assembly in place to dump the waste material into an anti-static plastic bag or a similarly suited container without having to remove the wiper blades. The customer might prefer to dump the waste by removing the wiper blades to vacuum clean the sump or by other means. Because of the inherent higher precision of mounting the wiper blades to the web surface, the web cleaning apparatus reduces the variability in the torque load against the web drive plus it also allows for lower wiper blade engagement with the web and thus reducing the torque load needed for cleaning said web of particulates. Lower wiper blade engagement allows for higher blade working angle with the moving web, which is more effective to cleaning operation. The de-coupling of the sump from the lower bracket assembly might only be required if a new web cleaning apparatus is needed. We expect this operation to seldom be needed.

The invention has been described in detail with particular reference to certain preferred embodiments thereof, but it will be understood that variations and modifications can be effected within the spirit and scope of the invention.

PARTS LIST

100 electrophotographic document printer
102 primary image-forming member
104 photoconductor drum, image recording member
106 corona charger
108 LED writer
110 magnetic brush applicator
112 intermediate image-transfer member
114 transfer nip
115 cleaning brush

116 electrically conductive drum
118 compliant blanket
120 hard overcoat
122 power supply
S image-receiver sheet
124 transfer nip
126 small transfer roller
128 endless sheet-transfer web
130 cleaning brush
132 feed station
134 drive roller, grounded
136 transport roller, grounded
L Lips of sump, front and rear
M Motor
O Opening in the cover assembly
138 corona charging station
140 transfer roller power supply
142 detack charger
144 web conditioning charger
150 web cleaning apparatus
152 backup shoe assembly
154 lower bracket assembly
156 web cleaning cartridge or device
B mounting screws
158 notched and conically shaped pins, lower bracket assembly, rear
160 hole/slot pattern, backup shoe assembly, rear
161 shield and tape assembly, rear bracket
162 latch
164 latch keeper
166 slot features, web-cleaning cartridge, sides
168 plunger, lower bracket assembly, sides
170 shoe with T-shaped extrusion form for higher rigidity
172 front bracket, backup shoe assembly
174 tab feature of front bracket, backup shoe assembly
174*a* slanted feature, tab feature of front bracket, backup shoe assembly
176 tab feature, lower bracket assembly
177 guide adaptor, lower bracket assembly
177*a* slanted feature, guide adaptor, lower bracket assembly
178 rear bracket, backup shoe assembly
179 shield and tape assembly, rear bracket, backup shoe assembly
N notches in rear pins 158
180 side tabs, backup shoe assembly (static dissipative brush)
182 rectangular opening, lower bracket assembly
184 front flat surfaces, lower bracket assembly
186 rear flat surfaces, lower bracket assembly
188 end springs, web-cleaning cartridge
190 latch bracket, lower bracket assembly
192 stops, web-cleaning cartridge sump
194A, 194B first and second cleaning blades, wiper blades
194A first blade, metallic, having free extension W1, thickness t1, stiffness/unit length (K/L)1
194B second blade, metallic or polyurethane, having free extension W2, thickness t2, stiffness/unit length (K/L)2
β Blade working angle with the web at contact
196 cover assembly
198 sump, sump housing
200 cavity or reservoir, sump
202 integral molded baffles with notches, sump
210 hinge formed by slots 210A, and tabs 210B
210A slots or hinge receiver, sump
210B tabs or hinge device, cover assembly
214 upper boss, sump
216 notch feature in cover assembly
218 fasteners, cover assembly
220 thread inserts molded in the sump
222 side seals
224 blade seal
226 tab
227 Blade material component
227A Uniform thickness profiled blade, metallic or polyurethane
227B Profiled metallic blade with a step down in thickness
228 wiper blade stiffener, steel
228*a,b* wiper blade end-piece
228*c* locating pins
228*d* tapped holes
228*e* locking bolts
229 blade holder or clamp
230 hinge for blade holder
230A molded groove
230B locking springs for wiper blades
230C cutout for locking spring
230D screw inserts, molded groove of cleaner sump
232 seat feature for a gasket seal, sump
234 gasket seal, foam gasket, foam seal
236 baffle notches
R molded ribs, front and rear of sump
ST stem, plunger
WL Warning label for special care in handling of metallic blade, cover assembly of web cleaning cartridge
W' total width of the blade material
W free extension of the blade material from the blade holder
$W_e$ etched side width
t' base thickness of blade material
t etched thickness for stepped profile or blade thickness for uniform thickness blade profile

The invention claimed is:

1. A toner removal apparatus for cleaning particulate material from a moving surface in an electrographic printer, the apparatus adapted to contact the surface to remove particles from the surface comprising:

a. two or more releasable wiper blades comprising at least one profiled metal blade, having a stepped thickness profile wherein a first blade is closest to a first cleaning contact point and a second blade is farther from the first cleaning contact;

b. a holder comprising one or more placement devices to cooperate with the profiled metal blade to hold said blade in place proximate a surface at a working angle of 40-75 degrees for cleaning particulate material from the moving a surface; and c. a cover assembly to facilitate the removal of debris material from a sump without removing the wiper blades.

2. The apparatus of claim 1 wherein the stepped profile thickness ranges between 0.002" to 0.003" and the stepped down thickness extends 0.180" to 0.325" from the contact edge.

3. The apparatus of claim 1 wherein the stepped profile thickness comprising an etched profile is on both sides of the profiled metal blade.

4. The apparatus of claim 1 wherein the stepped profile comprises a width narrower than the blade free extension for varying the stiffness/length ratio for the blade.

5. The apparatus of claim 1 wherein the profiled metal blade cleans a movable web surface having a Rz, roughness between 1 to 4 microns as well as a coated Gamma-Aluminum web having abrasive particles size of 0.5 microns or less.

6. The apparatus of claim 1 wherein one or more of the profiled metal blades comprise one or more rounded corners with a radius of 1-5 mm.

7. The apparatus of claim 1 further comprises two or more blade holders so that the holders enable a free extension of 0.200"-0.350" and an engagement in the range of 0.010" to 0.035".

8. The apparatus of claim 7 such that the profiled blade has a stepped thickness profile held at a thickest portion of the blade and a thinner thickness profile extending beyond the free extension to reduce the blade stiffness.

9. The apparatus of claim 7 such that the profiled blade has a stepped thickness profile held at a thickest portion of the blade and a thinner thickness profile shorter than the free extension to increase the blade stiffness.

10. The apparatus of claim 1, the blades comprise one or more polyurethane blades having a stiffness/unit length from 2-5 psi and one or more metallic blades having a stiffness/unit length from 2-16 psi, having an uniform thickness profile between 0.002-0.0035".

11. The apparatus of claim 10, the polyurethane wiper blade comprising a hardness of between 60 and 85 Shore A, an initial modulus of between 500 and 1500 psi, a Bayshore resiliency above 30%, and a compression set lower than 25%.

12. The apparatus of claim 10, the two cleaner blades comprising a first metallic blade closest to a first cleaning contact having a higher stiffness than a second metallic blade.

13. The apparatus of claim 10, further comprising blade holders for the blades of different thickness so that the placement enables easy installation for an operator having a metallic blade which seats in a first position farther from the first cleaning contact and has the required properties to maintain good cleaning performance.

14. The apparatus of claim 1 wherein the blades further comprise from the cleaning point comprises a first stiffer blade having a stiffness/unit length, K/L of 2-32 psi.

15. A toner removal apparatus for cleaning particulate material from a moving surface in an electrographic printer, the apparatus adapted to contact the surface to remove particles from the surface comprising:

a. two or more releasable wiper blades comprising at least one profiled metal blade;

b. a holder comprising one or more placement devices to cooperate with the profiled metal blade to hold said blade in place proximate a surface for cleaning particulate material from the moving a surface; and c. a cover assembly to facilitate the removal of debris material from a sump without removing the wiper blades wherein the profiled metal blade comprises a stepped thickness profile.

16. The apparatus of claim 15 wherein the profiled metal blade comprises a stepped thickness profile.

17. The apparatus of claim 15 wherein the stepped profile thickness, comprising an etched profile, ranges between 0.002" to 0.003" on a contact edge, the free extension for the etched profile is 0.250" and the stepped down thickness extends 0.180" to 0.325" from the contact edge.

18. The apparatus of claim 17 wherein the stepped profile thickness is on either the contact edged or the other edge or both.

19. The apparatus of claim 15 wherein the profiled metal blade cleans a movable web surface having a Rz, roughness between 1 to 4 microns as well as a coated Gamma-Aluminum web having abrasive particles size of 0.5 microns or less.

20. The apparatus of claim 15 further comprises two or more blade holders so that the holders enable a free extension of 0.200"-0.350" and an engagement in the range of 0.010" to 0.035".

21. The apparatus of claim 15 wherein one or more of the profiled metal blades comprise one or more rounded corners with a radius of 1-5 mm.

22. The apparatus of claim 15 wherein the blades further comprise from the cleaning point comprises a first stiffer blade having a stiffness/unit length, K/L of 2-32 psi.

23. The method of fabricating a stepped thickness profile blade comprising:

a. fabricating a first metallic blade comprising shearing, grinding and polishing to generate square edges before electropolishing to round the edges to create a radius of less than 10 u, preferably less than 5 u;

b. fabricating a second metallic blade comprising shearing, grinding and polishing to generate square edges before electropolishing to round the edges to create a radius of less than 10 u, preferably less than 5 u; and c. calculating the K/L of each blade to assure that the first and second metallic blades comprises a K/L ratio that reduces the loading effect and wear on a coated web surface comprising a higher roughness measurement term in terms of Rz, where the roughness measurement term estimates the height from the peak to valley of the surface of the coated web or a higher abrasive nature of a coating or for removal of paper contaminants that are hard to remove from these surfaces.

24. The method of claim 23 further comprising calculating the engagement depth of each blade relative to the desired stiffness and wear characteristic desired.

* * * * *